US006752676B2

(12) United States Patent
Yamashita et al.

(10) Patent No.: US 6,752,676 B2
(45) **Date of Patent: *Jun. 22, 2004**

(54) METHODS FOR PRODUCING ELECTRON-EMITTING DEVICE, ELECTRON SOURCE, AND IMAGE-FORMING APPARATUS

(75) Inventors: Masataka Yamashita, Chigasaki (JP); Hisaaki Kawade, Yokohama (JP); Toshikazu Ohnishi, Sagamihara (JP); Tatsuya Iwasaki, Machida (JP); Takeo Ono, Sagamihara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/250,400

(22) Filed: Feb. 16, 1999

(65) Prior Publication Data

US 2002/0016124 A1 Feb. 7, 2002

(30) Foreign Application Priority Data

Feb. 16, 1998 (JP) ..... 10-031890
Feb. 15, 1999 (JP) ..... 11-035442

(51) Int. Cl.[7] ..... H01J 09/02
(52) U.S. Cl. ..... 445/6; 445/24
(58) Field of Search ..... 445/6, 24, 51

(56) References Cited

U.S. PATENT DOCUMENTS 5,066,883 A 11/1991 Yoshioka et al. ..... 313/309
5,674,100 A * 10/1997 Ono et al.
6,034,478 A * 3/2000 Kawade et al.

FOREIGN PATENT DOCUMENTS

| | | | |
|---|---|---|---|
| EP | 693 766 | | 1/1996 |
| EP | 715 329 | | 6/1996 |
| EP | 0 717 428 | | 6/1996 |
| EP | 732 721 | | 9/1996 |
| EP | 769796 | * | 4/1997 |
| EP | 789 383 | | 8/1997 |
| JP | 64-19658 | | 1/1989 |
| JP | 64-31332 | | 2/1989 |
| JP | 1 283749 | | 11/1989 |
| JP | 2 257552 | | 10/1990 |
| JP | 6-12997 | | 1/1994 |
| JP | 06 012997 | | 1/1994 |
| JP | 08-031311 | | 2/1996 |
| JP | 9-223459 | | 8/1997 |
| JP | 09-298029 | | 11/1997 |

OTHER PUBLICATIONS

W. P. Dyke and W. W. Dolan, "Field Emission," Advances in Electronics and Electron Physics, 89–185 (1956).
C. A. Spindt, "Physical Properties of Thin–Film Field Emission Cathodes with Molybdenum Cones," J. Appl. Phys., V. 47, 5248–5263 (Dec. 1976).
C. A. Mead, "Operation of Tunnel–Emission Devices," J. Appl. Phys., V. 32, 646–652 (Apr. 1961).

(List continued on next page.)

*Primary Examiner*—Kenneth J. Ramsey
(74) *Attorney, Agent, or Firm*—Fitzpatrick, Cella, Harper & Scinto

(57) ABSTRACT

A method for producing an electron-emitting device having an electroconductive film with an electron-emitting region extending between plural electrodes, includes a step of forming the electron-emitting region in the electroconductive film, including a step of heating the electroconductive film, and a step of energizing the electroconductive film in an atmosphere in which a gas for promoting cohesion of the electroconductive film exists.

41 Claims, 17 Drawing Sheets

OTHER PUBLICATIONS

M. I. Elinson et al., "The Emission of Hot Electrons and the Field Emission of Electrons from Tin Oxide," Radio Eng. & Electron Phys., V. 10, 1290–1296 (Jul. 1965).

G. Dittmer, "Electrical Conduction and Electron Emission of Discontinuous Thin Film," Thin Solid Films, 9, 317–328 (1972).

M. Hartwell and C. G. Fonstad, "Strong Electron Emission from Patterned Tin–Indium Oxide Thin Films," IEEE Trans. ED Conf. (IEDM), 519–521 (1975).

Hisashi Araki et al., "Electroforming and Electron Emission of Carbon Thin Films," Shinku (Vacuum), vol. 26, No. 1, pp. 22–29 (1983), (with English Abstract).

* cited by examiner

METHODS FOR PRODUCING ELECTRON-EMITTING DEVICE, ELECTRON SOURCE, AND IMAGE-FORMING APPARATUS

BACKGROUND OF THE INVENTION

1. Field of the Invention

The present invention relates to methods for producing an electron-emitting device, an electron source comprised of a plurality of such electron-emitting devices, and an image-forming apparatus such as a display device or the like constructed using the electron source.

2. Related Background Art

The conventionally known electron-emitting devices are generally classified under two types, thermionic electron-emitting devices and cold-cathode electron-emitting devices. The cold-cathode electron-emitting devices include field emission type (hereinafter referred to as "FE type") devices, metal/insulator/metal type (hereinafter referred to as "MIM type") devices, surface electron-emitting devices, and so on.

Examples of FE type devices include those disclosed in W. P. Dyke and W. W. Dolan, "Field Emission," Advance in Electron Physics, 8, 89 (1956) or in C. A. Spindt, "Physical Properties of thin-film field emission cathodes with molybdenum cones," J. Appl. Phys., 47, 5248 (1976), and so on.

Examples of known MIM type devices include those disclosed in C. A. Mead, "Operation of Tunnel-Emission Devices," J. Appl. Phys., 32, 646 (1961), and so on.

Examples of surface conduction electron-emitting devices include those disclosed in M. I. Elinson, Radio Eng. Electron Phys., 10, 1290 (1965), and so on.

Surface conduction electron-emitting devices utilize a phenomenon that electron emission occurs when electric current is allowed to flow in parallel to the surface in a thin film of a small area formed on an insulating substrate. Examples of surface conduction electron-emitting devices reported heretofore include those using a thin film of $SnO_2$ by Elinson et al. cited above, those using a thin film of Au [G. Dittmer: "Thin Solid Films," 9, 317 (1972)], those using a thin film of $In_2O_3/SnO_2$ [M. Hartwell and C. G. Fonstad: "IEEE Trans. ED Conf.," 519, (1975)], those using a thin film of carbon [Hisashi Araki et al.: Shinku (Vacuum), Vol. 26, No. 1, p22 (1983)], and so on.

A typical example of these surface conduction electron-emitting devices is the device structure of M. Hartwell cited above, which is schematically shown in FIG. 18. In the same drawing, numeral 1 designates a substrate. Numeral 4 denotes an electrically conductive film, which is, for example, a thin film of a metallic oxide formed in an H-shaped pattern and in which an electron-emitting region 5 is formed by an energization operation called energization forming described hereinafter. In the drawing the gap L between the device electrodes is set to 0.5–1 mm and the width W' to 0.1 mm.

In these surface conduction electron-emitting devices, it was common practice to preliminarily subject the conductive film 4 to the energization operation called energization forming, prior to execution of electron emission, thereby forming the electron-emitting region 5. Specifically, the energization forming is an operation for applying a voltage to both ends of the conductive film 4 to locally break, deform, or modify the conductive film 4, thereby forming the electron-emitting region 5 in an electrically high resistance state. In the electron-emitting region 5 a fissure is formed in part of the conductive film 4 and electrons are emitted from near the fissure.

The surface conduction electron-emitting devices described above have an advantage of capability of forming an array of many devices across a large area, because of their simple structure. A variety of applications have been studied heretofore in order to take advantage of this feature. For example, they are applied to charged beam sources, and image-forming apparatus such as display devices and the like.

An example of a conventional application to formation of an array of many surface conduction electron-emitting devices is an electron source comprised of a lot of rows (in a ladder-like configuration), each row being formed by arraying the surface conduction electron-emitting devices in parallel and connecting both ends (both device electrodes) of the individual surface conduction electron-emitting devices by wires (common wires) (for example, see Japanese Laid-open Patent Applications No. 64-31332, No. 1-283749, and No. 2-257552).

Particularly, in the case of a display device, it can be formed as a plane type display device, similar to the display device made using a liquid crystal, and an example suggested as a self-emission type display device necessitating no back light is a display device comprised of a combination of an electron source consisting of a lot of surface conduction electron-emitting devices with a fluorescent member which emits visible light under irradiation with electron beams from the electron source (U.S. Pat. No. 5,066,883).

There are some conventional methods known as methods for producing the surface conduction electron-emitting devices described above. For example, a variety of methods, including vacuum vapor deposition, sputtering, chemical vapor deposition, dispersion coating, dipping coating, spinner coating, ink jet process (EP-A-0717428), and so on, are known as methods for forming the electroconductive film to be subjected to the above energization forming operation. The known energization forming methods on the electroconductive film include a method for energizing the electroconductive film while heating a substrate on which the electroconductive film is laid (Japanese Laid-open Patent Application No. 64-019658), a method for energizing the electroconductive film under a reducing ambience (Japanese Laid-open Patent Application No. 6-012997, EP-A-0732721), and so on.

In formation of the electroconductive film, it is desirable to form the film in uniform thickness in order to obtain good electron emission characteristics. There appear, however, differences in the uniformity, depending upon differences among the methods employed. Further, in the energization forming operation, particularly, where the forming operation of individual conductive films is carried out through wires to which the many conductive films are connected, thereby forming electron-emitting regions therein, it is desirable to perform such forming operation as to minimize variations in the electron emission characteristics among the individual conductive films. However, differences become greater in the variations of the characteristics as the number of electroconductive films connected increases.

SUMMARY OF THE INVENTION

An object of the present invention is to provide methods for producing an electron-emitting device capable of presenting good electron emission characteristics, an electron source incorporating such electron-emitting devices, and an image-forming apparatus.

Another object of the present invention is, particularly, to provide methods for producing an electron-emitting device capable of presenting good electron emission characteristics, independent of a method for forming its electroconductive film, an electron source incorporating such electron-emitting devices, and an image-forming apparatus.

Another object of the present invention is, particularly, to provide methods for producing an electron-emitting device capable of presenting good electron emission characteristics even with the energization operation on an electroconductive film having some thickness irregularities, an electron source incorporating such electron-emitting devices, and an image-forming apparatus.

Another object of the present invention is, particularly, to provide a method for producing an electron source having a plurality of electron-emitting devices with less variations in the electron emission characteristics.

Another object of the present invention is to provide a method for producing an image-forming apparatus capable of forming a higher-quality image.

For accomplishing the above objects, the present invention provides a method for producing an electron-emitting device comprising an electroconductive film having an electron-emitting region between electrodes, wherein a step of forming said electron-emitting region in the electroconductive film comprises a step of heating the electroconductive film and a step of energizing the electroconductive film, in an atmosphere in which a gas for promoting cohesion of the electroconductive film exists.

The present invention also provides a method for producing an electron-emitting device comprising an electroconductive film having an electron-emitting region between electrodes, wherein a step of forming said electron-emitting region in the electroconductive film comprises a step of energizing the electroconductive film while heating the electroconductive film, in an atmosphere in which a gas for promoting cohesion of the electroconductive film exists.

The present invention also provides a method for producing an electron source having a plurality of electron-emitting devices, wherein said electron-emitting devices are produced by either of the above-described methods for producing the electron-emitting device.

The present invention also provides a method for producing an image-forming apparatus comprising an electron source having a plurality of electron-emitting devices and an image-forming member for forming an image under irradiation of electrons from the electron source, wherein said electron-emitting devices are produced by either of the above-described methods for producing the electron-emitting device.

DETAILED DESCRIPTION OF THE PREFERRED EMBODIMENTS

The present invention will be described in detail with an example of the plane type surface conduction electron-emitting device as a preferred embodiment of the present invention.

Figure 1A:
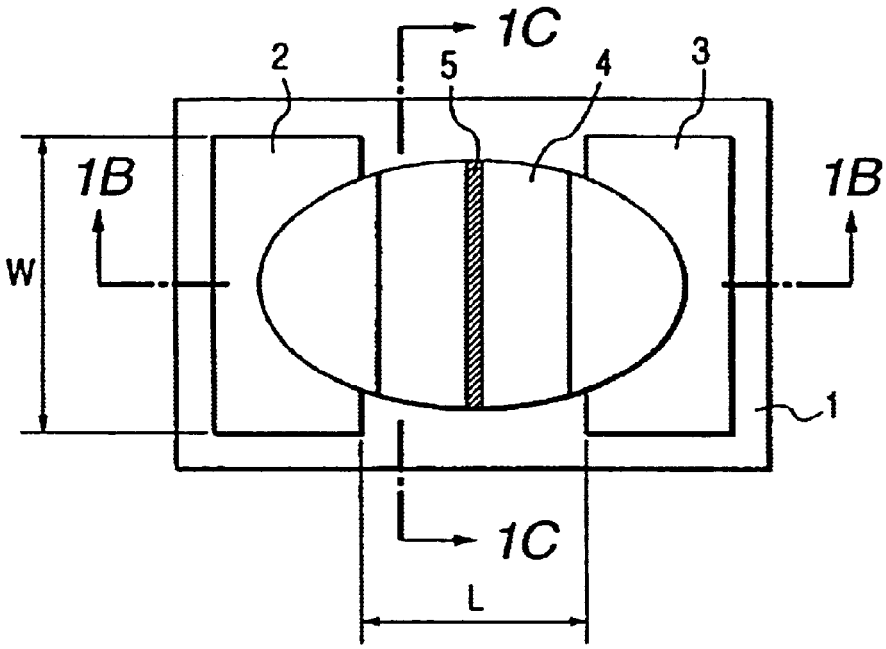
FIGS. 1A, 1B and 1C are schematic structural diagrams showing a plane type surface conduction electron-emitting device as an embodiment of the electron-emitting device of the present invention.
Figure 1B:
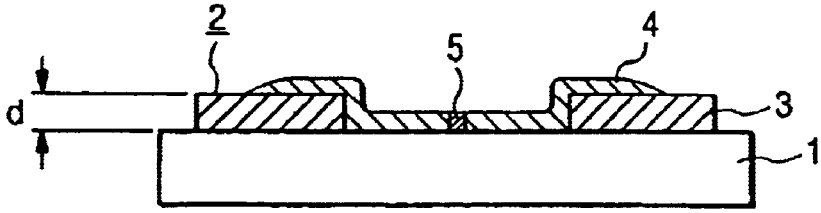
Figure 1C:
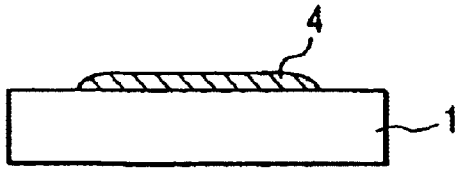

FIGS. 1A, 1B and 1C are schematic diagrams to show an embodiment of the plane type surface conduction electron-emitting device, wherein FIG. 1A is a plan view, FIG. 1B is a sectional view along section line 1B—1B in FIG. 1A, and FIG. 1C is a sectional view along section line 1C—1C in FIG. 1A. In FIGS. 1A, 1B and 1C, reference numeral 1 designates a substrate, 2 and 3 device electrodes, 4 an electroconductive film, and 5 an electron-emitting region. As illustrated in FIGS. 1A, 1B, and 1C, the electroconductive film 4 in the present embodiment is often formed in a structure that is thick in the central part and becomes thinner toward the periphery.

The substrate 1 can be selected from silica glass, glass containing a reduced amount of impurities such as Na or the like, soda lime glass, a laminate obtained by laying $SiO_2$ on soda lime glass by sputtering or the like, ceramics such as alumina or the like, an Si substrate, and so on.

A material for the device electrodes 2, 3 opposed to each other can be an ordinary conductive material, which is properly selected, for example, from metals such as Ni, Cr, Au, Mo, W, Pt, Ti, Al, Cu, Pd, and the like, alloys thereof, printed conductors composed of a metal or a metal oxide such as Pd, Ag, Au, $RuO_2$, Pd—Ag, or the like and glass or the like, transparent conductive materials such as $In_2O_3$—$SnO_2$ or the like, semiconductor conductive materials such as polysilicon or the like, and so on.

The gap L between the device electrodes, the length W of the device electrodes, the shape of the conductive film 4, etc. are designed, taking an application form or the like into consideration. The device electrode gap L is determined preferably in the range of several hundred nm to several hundred $\mu$m and more preferably in the range of several $\mu$m to several ten $\mu$m, taking the voltage placed between the device electrodes or the like into consideration.

The device electrode length W is determined preferably in the range of several $\mu$m to several hundred $\mu$m, taking the resistance of the electrodes and the electron emission characteristics into consideration and the thickness d of the device electrodes 2, 3 is preferably in the range of several ten nm to several $\mu$m.

In addition to the structure illustrated in FIGS. 1A, 1B, and 1C, the device can also be constructed in such structure that the conductive film 4 and the opposed device electrodes 2, 3 are stacked in the stated order on the substrate 1.

A material for the conductive film 4 can be selected, for example, from metals such as Pd, Pt, Ru, Ag, Au, In, Pb, and the like, and oxides such as PdO, $SnO_2$, $In_2O_3$, PbO, $Sb_2O_3$, and the like, and a material suitable for the operation conditions in the forming step described hereinafter is selected therefrom as occasion may demand.

The conductive film 4 is preferably a fine particle film comprised of fine particles in order to obtain good electron emission characteristics. The thickness of the conductive film (average thickness) is properly set, taking the step coverage over the device electrodes 2, 3 the resistance between the device electrodes 2, 3 and so on into consideration, and it is normally determined preferably in the range of 1 Å to several hundred nm and more preferably in the range of 1 nm to 50 nm. The resistance, $R_s$, is in the range of $1\times10^2$ to $1\times10^7$ Ω/□. $R_6$ is a value obtained when a resistance R measured in the longitudinal direction of a thin film having a width w and a length 1 is defined as $R=R_s$ (l/w), and $R_s=(\rho/t)$, where ρ is the resistivity.

The fine particle film stated herein is a film of aggregation of plural fine particles, the fine structure of which is a state in which some fine particles are individually dispersed and other fine particles are adjacent to each other or are overlapping with each other (including a state in which some fine particles are aggregated to form an island structure as a whole). The sizes of the fine particles are in the range of several Å to several hundred nm and preferably in the range of 1 nm to 20 nm.

Since the present specification uses the term "fine particles" frequently, the meaning thereof will be described below.

In general, small particles are called "fine particles" and particles smaller than those are called "ultra-fine particles." Particles still smaller than the "ultra-fine particles" and containing atoms in the number not more than about several hundred atoms are often called "clusters."

Boundaries between them are not exact, however, and they vary depending upon how to classify them with focus on what property. In addition, the "fine particles" and "ultra-fine particles" are sometimes together called as "fine particles," and the description in the present specification follows this definition.

For example, "Jikken Butsurigaku Koza (Lectures in Experimental Physics) 14: Surface and Fine Particles" (compiled by Tadao Kinoshita and published Sep. 1, 1986 by Kyoritsu Shuppan) describes "When fine particles are stated in this article, they indicate particles having the diameter of from about 2–3 $\mu$m to about 10 nm and, particularly, when ultra-fine particles are stated, they mean particles having the sizes of from about 10 nm to about 2–3 nm. The both together are sometimes called simply fine particles and the definition is not always precise but is a rough guide. If the number of atoms constituting a particle is 2 to about several tens to several hundreds, it will be called a cluster." (page 195, lines 22 to 26).

Stating in addition, the definition of "ultra-fine particles" by "Hayashi ultra-fine particle project" of Research Development Corporation of Japan defines a much smaller lower limit of particle size, which is as follows.

—"Ultra-fine particle project" (1981 to 1986) of Souzou Kagaku Gijutsu Suishin Seido (Creative Science and Technology Promotion Organization) determined that particles having the size (diameter) in the range of approximately 1 to 100 nm were called "ultra-fine particles." Then, one ultra-fine particle is an aggregate of 100 to $10^8$ atoms approximately. From the scale of atoms, the ultra-fine particles are large or giant particles.—("Ultra-Fine Particles-Creative Science and Technology," p2, lines 1 to 4, 1988, compiled by Chikara Hayashi, Ryoji Ueda, and Akira Tasaki and published by Mita Shuppan), and —a particle still smaller than the ultra-fine particles, i.e., one particle composed of several to several hundred atoms, is usually called a cluster.—(p2, lines 12 to 13 in the same book)

Keeping the ordinary names described above in mind, the "ultra-fine particle" in the present specification indicates an aggregate of many atoms or molecules, the lower limit of particle size of which is several Å to 1 nm approximately and the upper limit of which is about several $\mu$m.

The electron-emitting region 5 is comprised of a fissure area formed in part of the conductive film 4, and is dependent on a fissure forming technique described hereinafter. In some cases there exist conductive fine particles having sizes in the range of several Å to several ten nm inside the electron-emitting region 5. These conductive fine particles contain part or all of elements of the material forming the conductive film 4. The electron-emitting region 5 and the conductive film 4 near it also contain carbon or a carbon compound in some cases.

Figure 2A:
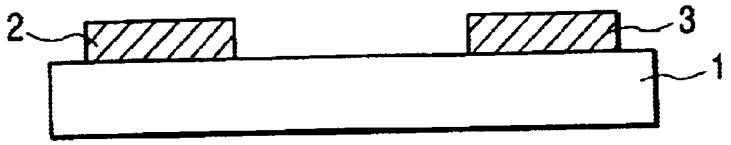
FIGS. 2A, 2B and 2C are diagrams showing a method for producing an electron-emitting device of the present invention.
Figure 2B:
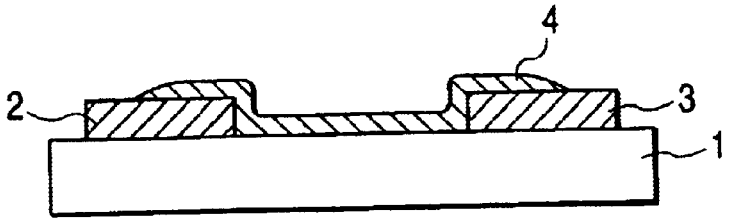
Figure 2C:
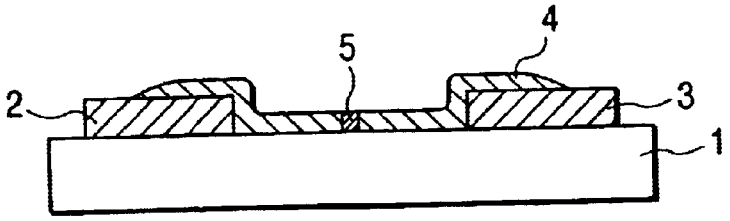

Next, a method for producing the electron-emitting device of the present embodiment will be described with reference to FIGS. 2A, 2B, and 2C. In FIGS. 2A, 2B, and 2C, the same portions as those illustrated in FIGS. 1A, 1B, and 1C are also denoted by the same reference numerals as those in FIGS. 1A, 1B, and 1C.

1) The substrate 1 is cleaned well with a detergent, pure water, and an organic solvent or the like, the material for the device electrodes is deposited thereon by vacuum vapor deposition, sputtering, or the like, and thereafter the device electrodes 2, 3 are formed on the substrate 1, for example, by the photolithography technology (FIG. 2A).

2) An organometallic solution is dispensed in the form of a droplet onto the substrate 1 provided with the device electrodes 2, 3 so as to establish connection between the device electrodes 2, 3 and is dried and heated to form the conductive film 4 (FIG. 2B). The organometallic solution is a solution of an organic compound the main element of which is the metal of the material for the conductive film 4 described above.

In the present embodiment the ink jet method is preferably applied as a means for dispensing the organometallic solution in the form of a droplet. When this ink jet method is adopted, small droplets ranging from approximately 10 ng to several ten ng can be generated and dispensed to the substrate with good repeatability and the method necessitates neither patterning by photolithography nor a vacuum process, which is thus preferable in terms of productivity. Devices of the ink jet method that can be used include those of the bubble jet method using an electrothermal transducer as an energy generating element, those of the piezo jet method using a piezoelectric device, and so on. A means for baking the above droplet is selected from electromagnetic wave irradiation means, hot air irradiation means, and means for heating the whole substrate. The electromagnetic wave irradiation means can be one selected, for example, from an infrared lamp, an argon ion laser, a semiconductor laser, and so on.

The method for forming the conductive film 4 is not limited to the above, but the method can be one selected from vacuum vapor deposition, sputtering, chemical vapor deposition, dispersion coating, dipping, spinner coating, and so on.

3) The next step is a forming step to form the electron-emitting region (FIG. 2C). Specifically, the substrate 1 on which the device electrodes 2, 3 and the conductive film 4 are formed is set in a vacuum apparatus and the inside of the vacuum apparatus is evacuated well by an evacuation apparatus. After that, the substrate is heated to increase the temperature and the voltage from an unrepresented power supply is placed between the device electrodes 2, 3 to effect energization. Then a gas for promoting reduction or cohesion of the material for the conductive film 4 is introduced into the vacuum vessel to locally break, deform, or modify the conductive film 4, whereby the electron-emitting region 5 of the changed structure is formed in the structure-changed portion. (FIG. 2C)

In the present embodiment, at the same time as the electron-emitting region 5 is formed by heating the conductive film 4 to the temperature not less than the room temperature, preferably 50° C. or more, and carrying out the energization operation in an atmosphere containing the gas for promoting reduction or cohesion of the conductive film 4 as described above, a cohesion operation is effected in the vicinity of the electron-emitting region. The temperature of the conductive film 4 is increased by current (membrane current) flowing in the conductive film 4 energized and the film at the increased temperature reacts with the gas for promoting reduction or cohesion to be reduced. This further increases the current and part of the conductive film 4 coheres to cause a structural change locally, thereby forming a fissure.

In an energization operation technique in which the substrate is not heated in the reduction or cohesion gas, adhesion of impurities on the surface of the conductive film 4 impedes the reduction or cohesion reaction between the gas and the material of the conductive film and the reaction starts after the impurities are removed by increase of temperature with energization. Therefore, the power is consumed more than expected. Particularly, there are some cases in which the current does not flow in thin portions of the conductive film because of high resistance and the temperature is not increased there to impede the reaction, so as to fail to form the fissure. In cases where the power is supplied through wires to which many devices are connected, excess current flows to increase voltage drops in the wires, whereby devices having different fissure forms are made with a large distribution of electron emission characteristics.

In the present embodiment the substrate 1 is heated to increase the temperature, whereby part of impurities such as water or the like adhering to the surface of the conductive film are removed to permit further promotion of the reaction between the reduction or cohesion gas and the conductive film 4. The reduction or cohesion thus proceeds even in the thin portions of the conductive film 4, so that the fissure is formed from edge to edge of the conductive film 4. Further, in the case of an electron source comprised of a plurality of electron-emitting devices or an image-forming apparatus incorporating the electron source, the energization operation step for forming the electron-emitting devices can be carried out at lower current and the voltage drops are lowered in the common wires, thereby achieving more even electron emission characteristics and enhancement of uniformity of luminance.

In the present embodiment the temperature at which the substrate 1 with the conductive film 4 formed thereon is heated is to be retained is properly determined depending upon the material for the conductive film 4. If this temperature is too high, the cohesion reaction will become excessive in the conductive film, so as to fail to form a preferred electron-emitting region in certain cases, or the cohesion will take place throughout the whole area of the conductive film, so that cohering particles will separate from each other, so as to lose electric conduction as the overall film in some cases. The upper limit of the retention temperature is preferably not more than 100° C., for example, where the material of the conductive film is fine particles of PdO.

In the present embodiment the aforementioned forming operation, as explained referring to FIGS. 2A, 2B, and 2C, is carried out under such condition that the substrate 1 is heated to a temperature higher than room temperature by an unrepresented heater and in an atmosphere containing a vapor (gas) for promoting reduction or cohesion of the conductive film 4.

When the conductive film 4 is made of a metallic oxide, the gas for promoting reduction or cohesion of the material for the conductive film 4 can be selected from reducing gases, for example, $H_2$, CO, $CH_4$, and so on. A conceivable reason is that cohesion occurs while the metallic oxide is reduced into metal. On the other hand, when the conductive film 4 is metal, promotion of cohesion does not occur with CO or $CH_4$, but the cohesion promoting effect is observed with use of $H_2$.

The above-stated forming step is preferably employed, particularly, in the case of the ink jet method, among the various forming methods of the conductive film 4. When the organometallic solution is dispensed in the form of a droplet as in the case of the ink jet method or the like, thicknesses of the solution dispensed differ depending upon locations because of surface tension of the droplet. Therefore, when the solution is dried and baked to form the conductive film, the conductive film has a distribution of film thicknesses because of the influence from the difference in the thicknesses due to the surface tension. Normally, the conductive film is thick in the center and becomes thinner toward the periphery. There are also cases in which the center is thin and the film becomes thicker toward the periphery, depending upon conditions. It is not easy to flatten the film thicknesses of the conductive film in either case.

In cases where the electron-emitting region is formed by the energization operation (forming operation) of the conductive film with the distribution of thicknesses described above, the resultant electron emission characteristics are sometimes inferior to those in the cases using the other forming methods of the conductive film 4.

Figure 21:
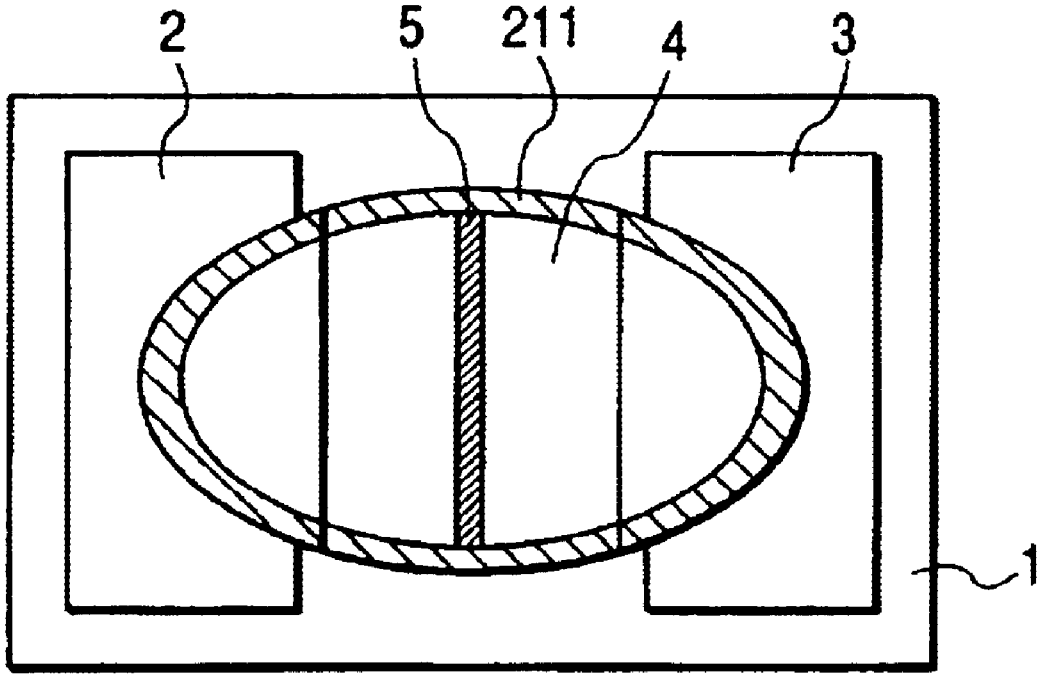
FIG. 21 is a schematic plan view showing an example of the conventional electron-emitting devices.

The first example is a case in which the electron-emitting region is not formed in the peripheral part of the conductive film where the thickness is the smallest, whereby the conductive film becomes continuous there to create a flow path of current. This state is illustrated in FIG. 21. In the figure, numeral 1 designates the substrate, 2 and 3 the device electrodes, 4 the conductive film, and 5 the electron-emitting region. The electron-emitting region 5 is not formed in the peripheral part 211 of the conductive film 4 because of its small thickness. Therefore, the current flows through the peripheral part 211 when the driving voltage is placed between the device electrodes 2, 3. This current does not contribute to emission of electrons and thus wastefully increases power consumption. The electron-emitting device of this structure essentially has nonlinear characteristics and no device current flows substantially below the threshold voltage. When the flow path is created as described above, an ohmic component appears in current-voltage characteristics.

The second example is such that the current flowing in the above energization operation is concentrated in a relatively thick portion to result in increasing the width of the fissure in the electron-emitting region, whereby sufficient emission of electrons becomes unlikely to occur. In this case, because the effective electron-emitting region is decreased, the number of electrons emitted is decreased.

For the above reasons, the aforementioned forming step is effective, particularly, where the forming method of the conductive film 4 including the droplet dispensing step like the ink jet method or the like is employed.

In the above forming step, waveforms of the voltage applied are preferably pulse waveforms in particular. For applying such pulses, there is a method illustrated in FIG. 4A for continuously applying pulses with a pulse peak height of a constant voltage and a method illustrated in FIG. 4B for applying pulses with increasing pulse peak heights.

Figure 4A:
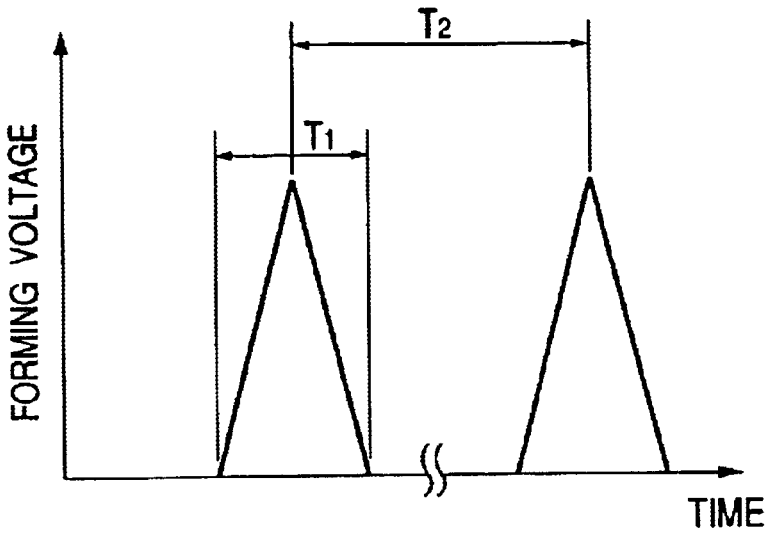
FIGS. 4A and 4B are diagrams showing examples of forming waveforms.

First described referring to FIG. 4A is the method for continuously applying pulses with a pulse peak height of the constant voltage. In FIG. 4A $T_1$ and $T_2$ represent pulse duration and pulse spacing of voltage waveforms respectively. Preferably, $T_1$ is set in the range of 1 $\mu$sec to 10 msec and $T_2$ is set in the range of 10 $\mu$sec to 10 msec. The peak height (the peak voltage during the energization forming) of triangular waves is properly selected according to the form of the surface conduction electron-emitting device. Under these conditions, the voltage is applied, for example, for several seconds to several ten seconds. The pulse waveforms are not limited to triangular waves, but can be any desired waveforms such as rectangular waves and the like.

Figure 4B:
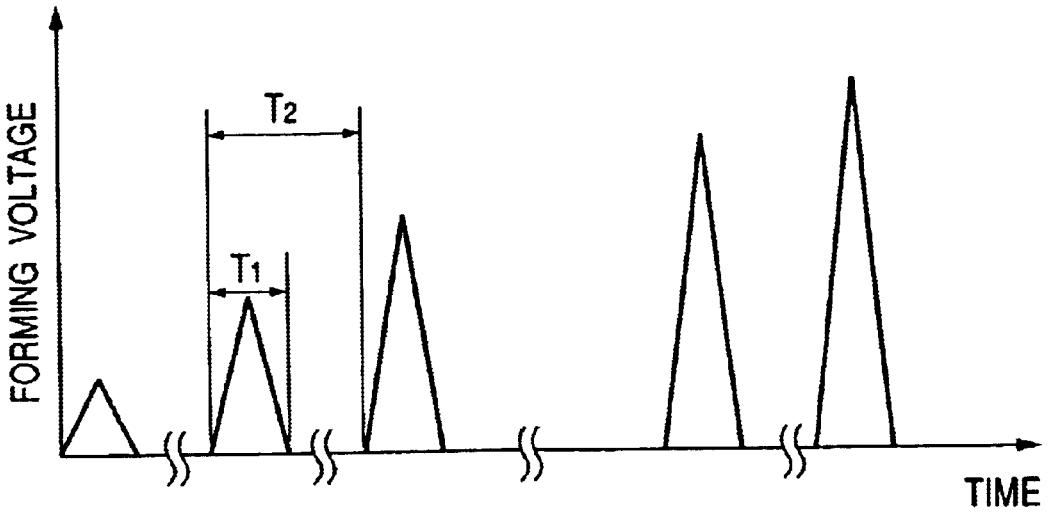

Next, with reference to FIG. 4B, a method for applying the voltage pulses with increasing pulse peak heights is described. In FIG. 4B, $T_1$ and $T_2$ are the same as $T_1$ and $T_2$ in FIG. 4A. The peak heights of the triangular waves are increased, for example, by steps of about 0.1 V.

The end of the energization forming operation can be detected in such a manner that a voltage too low to locally break or deform the conductive film 4 is applied during the pulse spacing $T_2$ and the current flowing at that time is measured. For example, the energization forming is terminated when the current is measured with application of the voltage of about 0.1 V and the resistance calculated therefrom is not less than 1 MΩ.

4) The device in which the electron-emitting region 5 is formed in the conductive film 4 is preferably subjected to an operation called an activation step. This activation step can change the device current $I_f$ and emission current $I_e$ remarkably.

The activation step can be carried out by repetitively applying pulses between the device electrodes 2, 3 for example, under an ambience containing gas of an organic substance. This ambience can be established by making use of organic gas remaining in the ambience where the inside of the vacuum vessel is evacuated using an oil diffusion pump or a rotary pump, for example. In addition, the ambience can also be obtained by introducing gas of an appropriate organic substance into a vacuum achieved once by sufficient evacuation by means of an ion pump or the like. The preferred gas pressure of the organic substance at this time varies depending upon the form of the device electrodes described above, the shape of the vacuum vessel, the kind of the organic substance, etc., and is properly determined depending upon circumstances. Appropriate organic substances are aliphatic hydrocarbons of alkane, alkene, and alkyne, aromatic hydrocarbons, alcohols, aldehydes, ketones, amines, organic acids such as phenol, carboxylic acid, sulfonic acid, and the like, and so on. Specifically, the organic substances applicable include saturated hydrocarbons represented by $C_nH_{2n+2}$ such as methane, ethane, propane, and the like, unsaturated hydrocarbons represented by the composition formula of $C_nH_{2n}$ or the like such as ethylene, propylene, and the like, benzene, toluene, methanol, ethanol, formaldehyde, acetaldehyde, acetone, methyl ethyl ketone, methylamine, ethylamine, phenol, formic acid, acetic acid, propionic acid, and so on. This operation causes carbon or a carbon compound to be deposited on the device from the organic substance existing in the ambience, thereby changing the device current $I_f$ and the emission current $I_e$ remarkably.

The carbon or carbon compound is, for example, graphite (including so-called HOPG, PG, and GC; HOPG indicating nearly perfect graphite crystal structure, PG indicating slightly disordered crystal structure having the crystal grains of about 20 nm, and GC indicating much more disordered crystal structure having crystal grains of about 2 nm) or non-crystalline carbon (indicating amorphous carbon and a mixture of amorphous carbon with fine crystals of the aforementioned graphite), and the thickness thereof is preferably not more than 50 nm and desirably not more than 30 nm.

The judgment of the end of the activation step can be properly made while measuring the device current $I_f$ and the emission current $I_e$. The pulse duration, the pulse spacing, the pulse peak heights, etc., are properly determined as occasion may demand.

5) The electron-emitting device obtained through these steps is preferably subjected to a stabilization step. This step is a step of exhausting the organic substance from the vacuum vessel. A vacuum evacuation apparatus for evacuating the vacuum vessel is preferably one not using oil in order to prevent oil generated from the apparatus from affecting the characteristics of the device. Specifically, the vacuum evacuation apparatus can be selected from an absorption pump, an ion pump, and so on.

In cases where in the aforementioned activation step the oil diffusion pump or the rotary pump was used as an evacuation apparatus and the organic gas resulting from the oil component generated therefrom was used, it is necessary to keep the partial pressure of this component as low as possible. The partial pressure of the organic substance in the vacuum vessel should be a partial pressure under which the aforementioned carbon or carbon compound is prevented substantially from being newly deposited, which is preferably not more than $1.3\times10^{-6}$ Pa and particularly preferably not more than $1.3\times10^{-8}$ Pa. Further, during the evacuation of the inside of the vacuum vessel, it is preferable to heat the whole vacuum vessel so as to facilitate the exhaust of organic molecules adhering to the inside wall of the vacuum vessel and to the electron-emitting device. The heating condition at this time is such that, desirably, the operation is carried out at 80–250° C., and preferably not less than 150° C., as long as possible, but the heating condition is not limited particularly to this condition. The heating is carried out under a condition properly selected according to various conditions including the size and shape of the vacuum vessel, the structure of the electron-emitting device, and so on. The pressure inside the vacuum vessel has to be set as low as possible, and is preferably not more than $1\times10^{-5}$ Pa and more preferably not more than $1.3\times10^{-6}$ Pa.

The ambience during driving after completion of the above stabilization step is preferably that at the time of completion of the stabilization operation, but it is not limited to this. As long as the organic substance is removed well, sufficiently stable characteristics can be maintained even with a little increase of the pressure itself. New deposition of carbon or the carbon compound can be suppressed by employing such vacuum ambience, so that the device current $I_f$ and the emission current $I_e$ become stable.

The basic characteristics of the electron-emitting device of the present invention will be described with an example of the plane type surface conduction electron-emitting device described previously, referring to FIG. 5 and FIG. 6.

Figure 5:
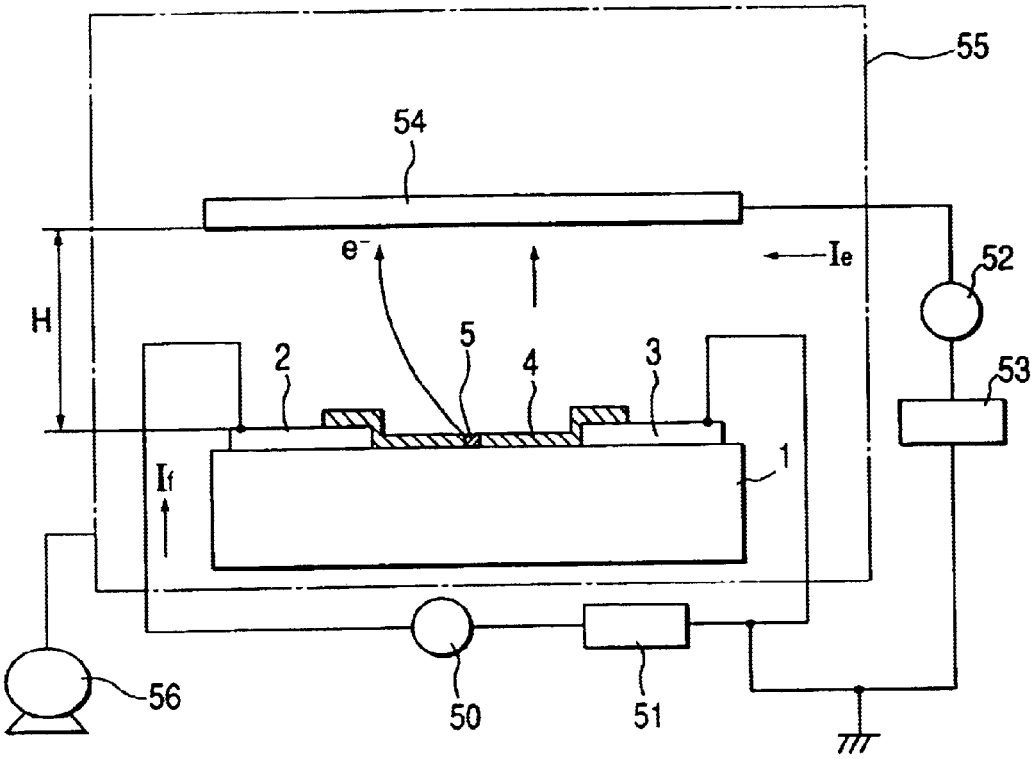
FIG. 5 is a schematic structural diagram showing an example of a vacuum process apparatus according to the present invention.

FIG. 5 is a schematic diagram showing an example of a vacuum process apparatus, and this vacuum process apparatus also has the function of a measuring and evaluating apparatus. In FIG. 5, the same portions as those illustrated in FIGS. 1A, 1B, and 1C are denoted by the same reference symbols as those in FIGS. 1A, 1B, and 1C.

In FIG. 5, reference numeral 55 represents a vacuum vessel and 56 an exhaust pump. The electron-emitting device is placed in the vacuum vessel 55. Specifically, numeral 1 designates the substrate forming the electron-emitting device, 2 and 3 the device electrodes, 4 the conductive film, and 5 the electron-emitting region. Numeral 51 indicates a power supply for applying the device voltage $V_f$ to the electron-emitting device, 50 indicates an ammeter for measuring the device current $I_f$ flowing in the conductive film 4 between the device electrodes 2 and 3, 54 indicates an anode electrode for capturing the emission current $I_e$ emitted from the electron-emitting region 5 of the device, 53 indicates a high-voltage power supply for applying a voltage to the anode electrode 54, and 52 indicates an ammeter for measuring the emission current $I_e$ emitted from the electron-emitting region 5. As an example, measurement is carried out under such conditions that the voltage of the anode electrode 54 is set in the range of 1 kV to 10 kV and the distance H between the anode electrode 54 and the electron-emitting device is in the range of 2 to 8 mm.

Equipment necessary for measurement under a vacuum atmosphere of a vacuum system or the like (not illustrated) is provided in the vacuum vessel 55 and is adapted to perform measurement and evaluation under a desired vacuum atmosphere.

The exhaust pump 56 is composed of an ordinary high vacuum system consisting of a turbo pump, a rotary pump, etc. and an ultra-high vacuum system consisting of an ion pump etc. The whole of the vacuum process apparatus in which the substrate of the electron-emitting device is placed, illustrated herein, can be heated by a heater not illustrated. Therefore, the steps of the aforementioned energization forming and after can also be performed using this vacuum process apparatus.

Figure 6:
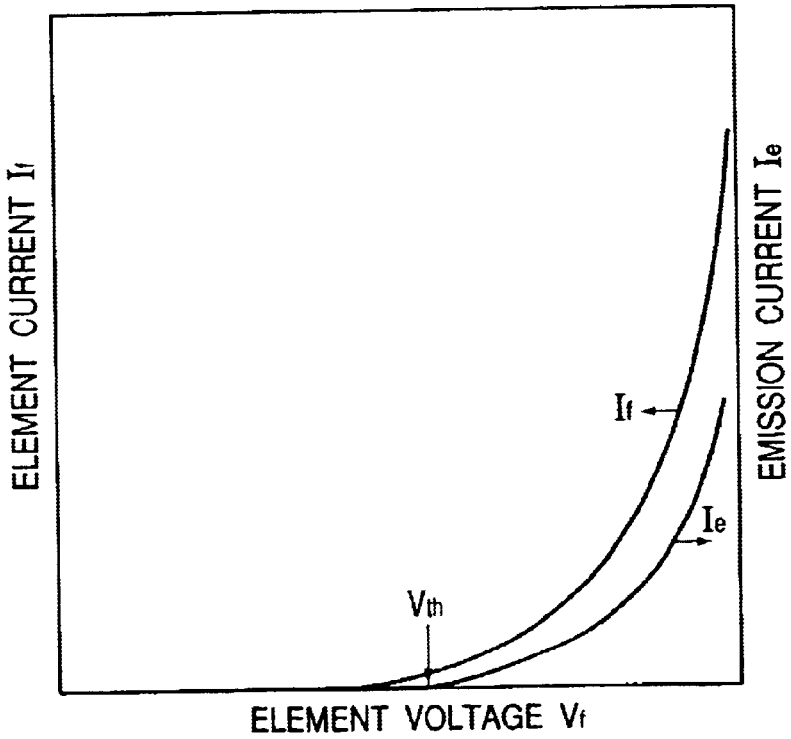
FIG. 6 is a diagram showing emission current vs. device voltage characteristics (I–V characteristics) of the electron-emitting device of the present invention.

FIG. 6 is a schematic diagram showing the relationship of the emission current $I_e$ and device current $I_f$, measured using the vacuum process apparatus illustrated in FIG. 5, versus the device voltage $V_f$. FIG. 6 is illustrated in arbitrary units, because the emission current $I_e$ is extremely small compared to the device current $I_f$. The abscissa and ordinate both are linear scales.

As is also apparent from FIG. 6, the electron-emitting device of the present invention has the following three characteristic properties as to the emission current $I_e$.

First, this device increases the emission current $I_e$ suddenly with application of a device voltage of not less than a certain voltage (which will be called a threshold voltage; $V_{th}$ in FIG. 6) and the emission current $I_e$ is rarely detected with a device voltage of not more than the threshold voltage $V_{th}$. Namely, the device is a nonlinear device having the definite threshold voltage $V_{th}$ against the emission current $I_e$.

Second, because the emission current $I_e$ has monotonically increasing dependence on the device voltage $V_f$, the emission current $I_e$ can be controlled by the device voltage $V_f$.

Third, emission charge captured by the anode electrode 54 (see FIG. 5) is dependent on the time of application of the device voltage $V_f$. Namely, the charge amount captured by the anode electrode 54 can be controlled by the time of application of the device voltage $V_f$.

As understood from the above description, the electron-emitting device of the present invention is an electron-emitting device the electron emission characteristics of which can be controlled readily according to an input signal. By making use of this property, the electron-emitting device of the present invention can be applied to equipment in various fields, including an electron source comprised of a plurality of such electron-emitting devices, an image-forming apparatus, and so on.

FIG. 6 shows the example in which the device current $I_f$ also monotonically increases against the device voltage $V_f$ (hereinafter referred to as "MI characteristics"), but it is noted that there are cases in which the device current $I_f$ demonstrates the voltage-controlled negative resistance characteristics (hereinafter referred to as "VCNR characteristics") against the device voltage $V_f$ (though not illustrated). These characteristics can be controlled by controlling the aforementioned steps.

Thanks to the characteristic properties of the electron-emitting device of the present invention described above, the electron source comprised of a plurality of such electron-emitting devices permits the emitted electron amount to be readily controlled according to the input signal, even in the image-forming apparatus or the like, and can be applied in various fields.

Application examples of the electron-emitting device of the present invention will be described below. For example, an electron source and an image-forming apparatus can be constructed by arraying a plurality of electron-emitting devices of the present invention on a substrate.

The array configuration of the electron-emitting devices can be selected from a variety of configurations. An example is a ladder-like configuration in which a lot of electron-emitting devices arranged in parallel are connected each at both ends, many rows of electron-emitting devices are arranged (in a row direction), and electrons from the electron-emitting devices are controlled by control electrodes (grid electrodes) disposed above the electron-emitting devices and along a direction perpendicular to the wires (i.e., in a column direction). Besides, another example is a configuration in which plural electron-emitting devices are arrayed in a matrix pattern along the X-direction and Y-direction, first electrodes of plural electron-emitting devices arranged in each row are connected to a common X-directional wire, and second electrodes of plural electron-emitting devices arranged in each column are connected to a common Y-directional wire. This configuration is a so-called simple matrix configuration. First, the simple matrix configuration will be detailed below.

The electron-emitting device of the present invention has the three characteristics described previously. Namely, electrons emitted from the electron-emitting device can be controlled by the peak height and width of a pulsed voltage signal applied between the opposed device electrodes in a range not less than the threshold voltage. On the other hand, electrons are rarely emitted in the range of not more than the threshold voltage. According to this characteristic, in the case of a configuration comprised of many electron-emitting devices, electron emission amounts can also be controlled for selected electron-emitting devices, in accordance with an input signal, by properly applying the pulsed voltage to the individual devices.

Figure 7:
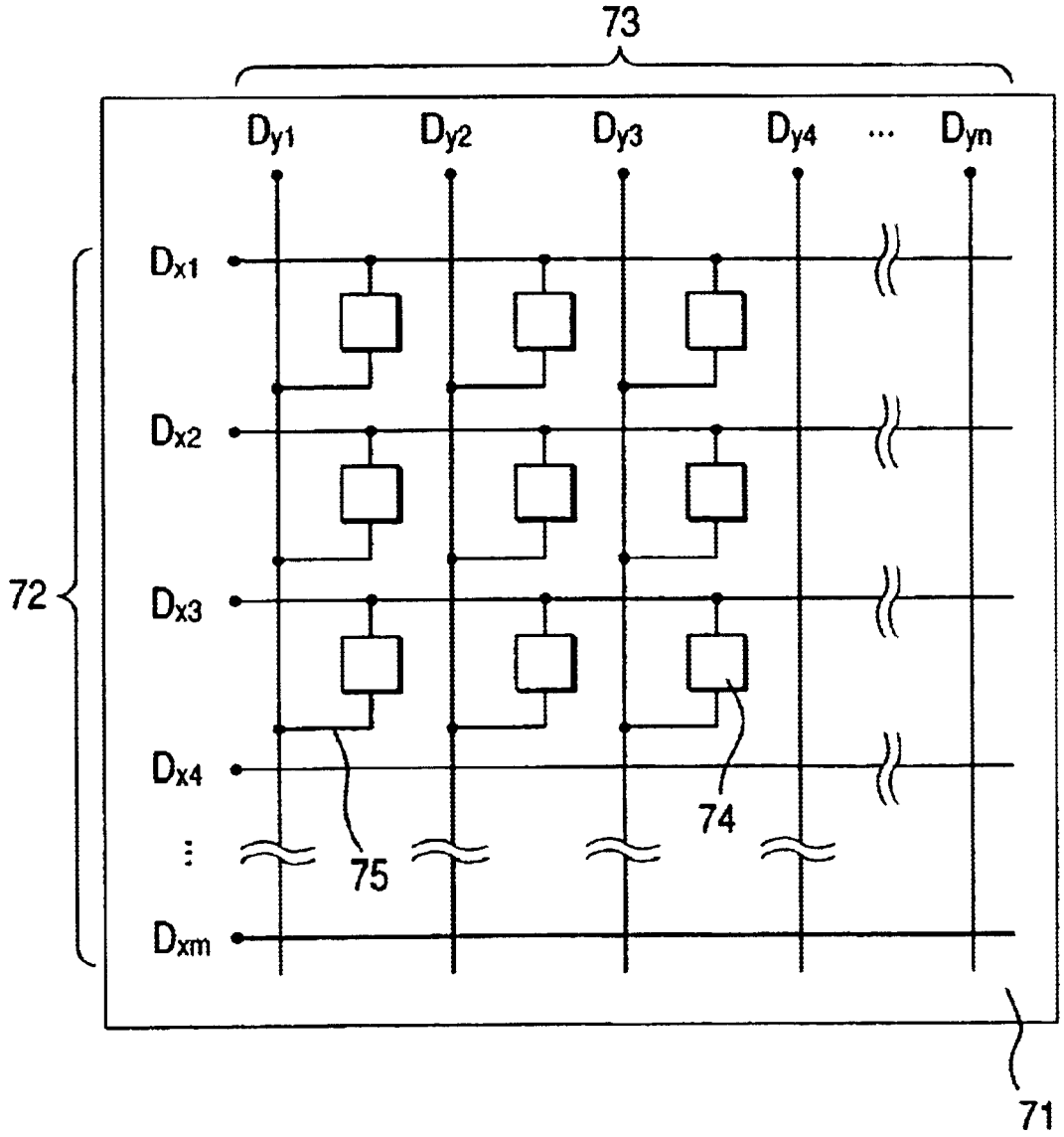
FIG. 7 is a schematic structural diagram showing an electron source of a simple matrix configuration as an embodiment of the electron source of the present invention.

Based on this principle, description will be given referring to FIG. 7 as to an electron source substrate obtained by arraying a plurality of surface conduction electron-emitting devices, which are an embodiment of the electron-emitting device of the present invention. In FIG. 7, reference numeral 71 designates an electron source substrate, 72 designates X-directional wires, and 73 designates Y-directional wires. Numeral 74 denotes surface conduction electron-emitting devices and 75 denotes connecting wires.

The m X-directional wires 72 are comprised of $D_{x1}$, $D_{x2}$, . . . , $D_{xm}$ and can be constructed of a conductive metal made by vacuum vapor deposition, printing, sputtering, or the like. The material, thickness, and width of the wires are designed properly as occasion may demand. The Y-directional wires 73 are n wires of $D_{y1}$, $D_{y2}$, . . . , $D_{yn}$ and are made in a similar fashion as are the X-directional wires 72. An interlayer insulating layer not illustrated is provided between-these m X-directional wires 72 and n Y-directional wires 73, thereby electrically separating them from each other (where m, n are both positive integers).

The interlayer insulating layer (not illustrated) is made of $SiO_2$ or the like and is made by vacuum vapor deposition, printing, sputtering, or the like. For example, the thickness, material, and production method of the insulating layer are properly set so that the interlayer insulating layer is formed on the entire surface or in a desired pattern on part of the substrate 71 on which the X-directional wires 72 are formed and, particularly, so that the insulating layer can withstand potential differences at intersecting portions between the X-directional wires 72 and the Y-directional wires 73. The X-directional wires 72 and Y-directional wires 73 are drawn out as external terminals.

Pairs of device electrodes (not illustrated) forming the electron-emitting devices 74 are electrically connected each to the m X-directional wires 72 and to the n Y-directional wires 73 by the connecting wires 75 of an electroconductive metal or the like.

The material for the X-directional wires 72 and the Y-directional wires 73, the material for the connecting wires 75, and the material for the pairs of device electrodes may share some or all of the constituent elements or may be different from each other. These materials are properly selected, for example, from the aforementioned materials for the device electrodes. If the material for the device electrodes is the same as the material for the wires, the wires connected to the device electrodes can be regarded as device electrodes.

Connected to the X-directional wires 72 is an unrepresented scanning signal applying means for applying a scanning signal for selecting a row of electron-emitting devices 74 aligned in the X-direction. On the other hand, connected to the Y-directional wires 73 is an unrepresented modulation signal generating means for modulating each column of the electron-emitting devices 74 aligned in the Y-direction, according to the input signal. A driving voltage applied to each electron-emitting device is supplied as a difference voltage between the scanning signal and the modulation signal applied to the device.

In the above configuration, the individual devices can be selected and driven independently, using the simple matrix wiring.

Figure 8:
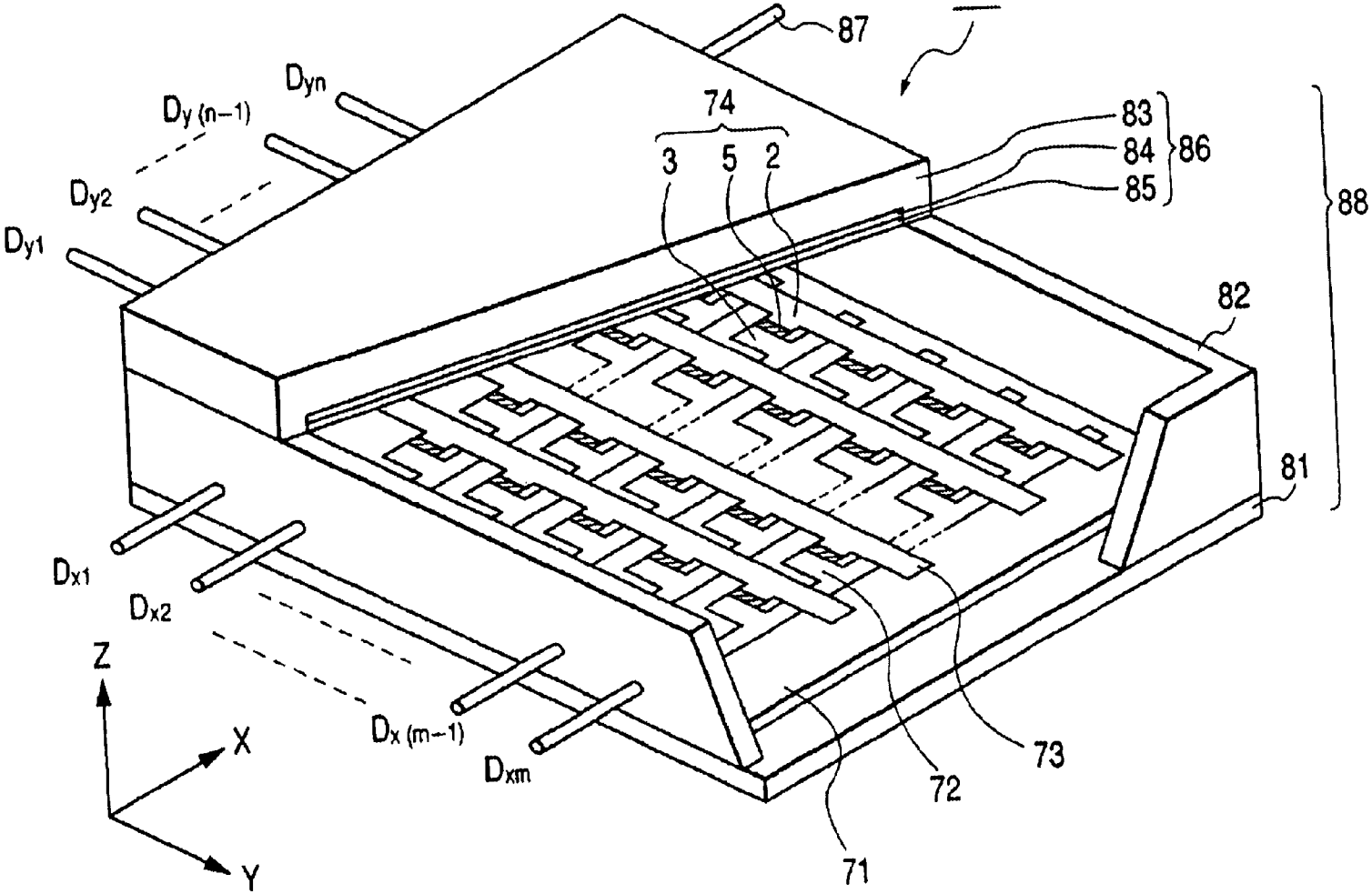
FIG. 8 is a schematic structural diagram of a display panel used in an embodiment of the image-forming apparatus of the present invention incorporating an electron source having a simple matrix configuration.
Figure 9A:
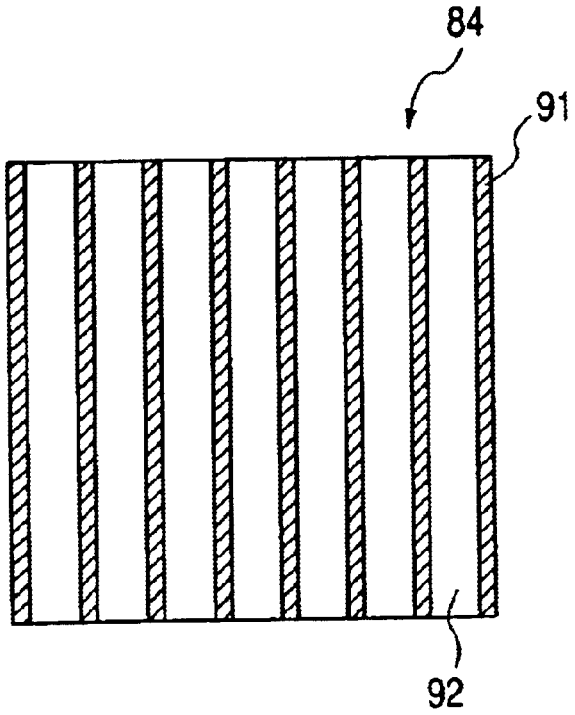
FIGS. 9A and 9B are diagrams showing fluorescent films in the display panel illustrated in FIG. 8.
Figure 9B:
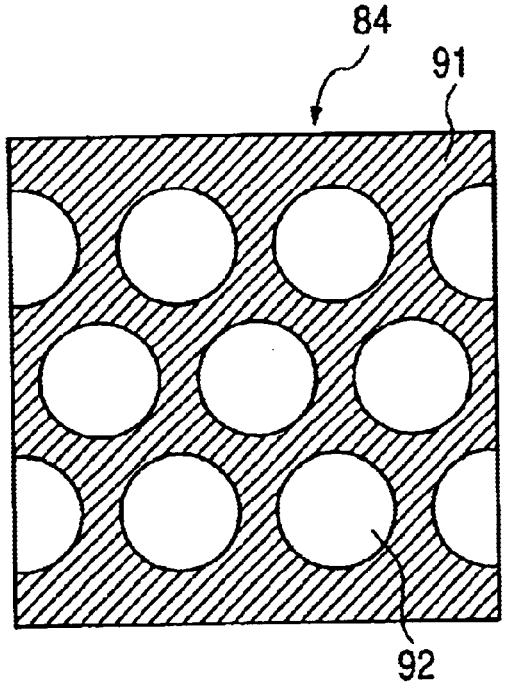
Figure 10:
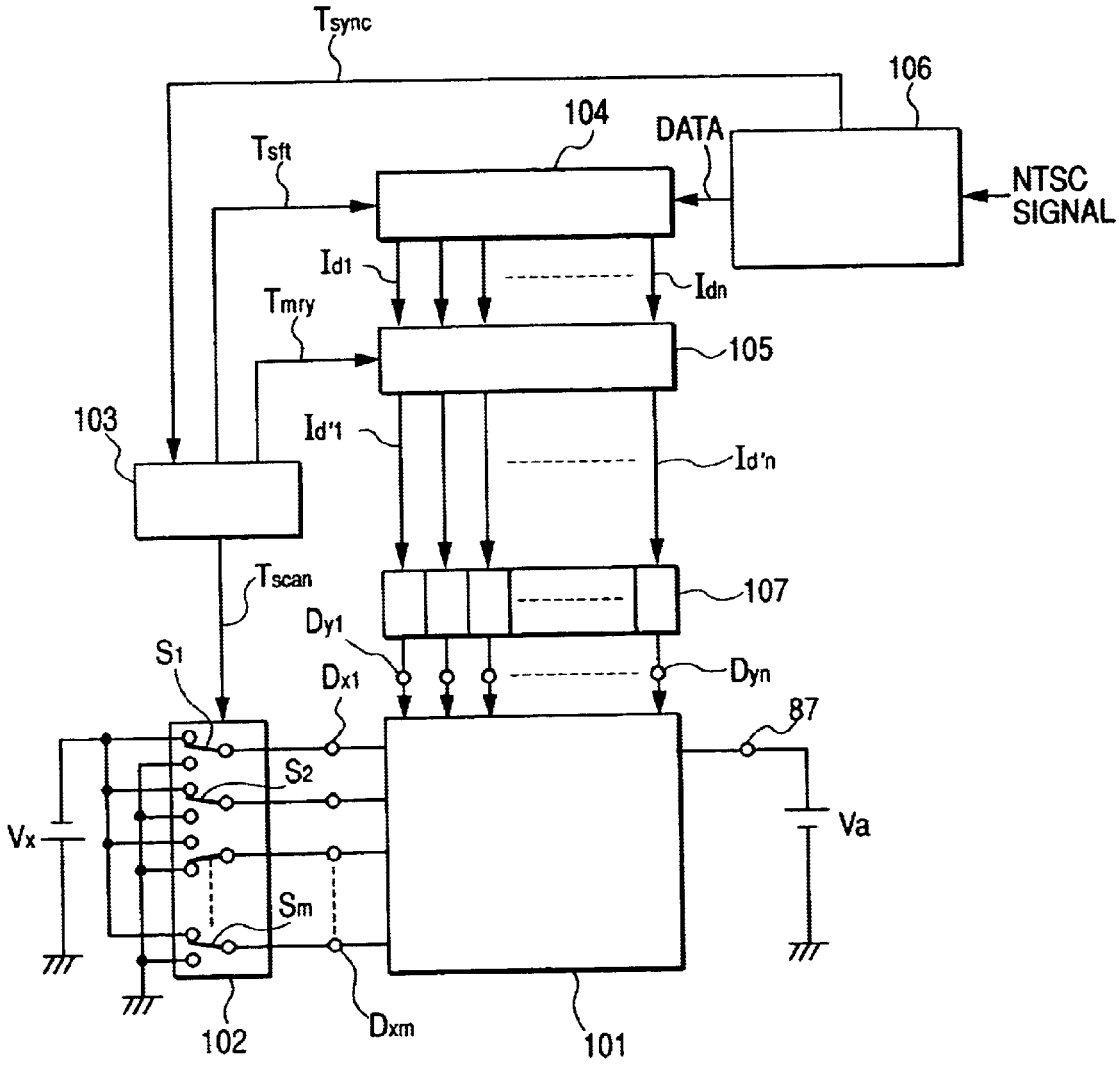
FIG. 10 is a diagram showing an example of driving circuitry for driving the display panel illustrated in FIG. 8.

An image-forming apparatus constructed using the electron source of this simple matrix configuration will be described referring to FIG. 8, FIGS. 9A and 9B, and FIG. 10. FIG. 8 is a schematic diagram showing an example of a display panel of the image-forming apparatus, and FIGS. 9A and 9B are schematic diagrams of fluorescent films used in the image-forming apparatus of FIG. 8. FIG. 10 is a block diagram showing an example of driving circuitry for carrying out display according to TV signals of the NTSC system. The same portions as those illustrated in FIG. 7 are denoted by the same reference symbols and are omitted from the description. The conductive films 4 are omitted from the illustration for convenience.

In FIG. 8, reference numeral 81 denotes a rear plate on which the electron source substrate 71 is fixed, and 86 denotes a face plate in which a fluorescent film 84, a metal back 85, etc. are formed on an inside surface of glass substrate 83. Numeral 82 designates a support frame, and the rear plate 81 and face plate 86 are connected to the support frame 82 with frit glass or the like. Numeral 88 is an envelope, which is sealed, for example, by baking it in the temperature range of 400° C. to 500° C. in atmosphere or in nitrogen for 10 or more minutes.

The envelope 88 is composed of the face plate 86, support frame 82, and rear plate 81, as described above. Since the rear plate 81 is provided for the main purpose of reinforcing the strength of the electron source substrate 71, the separate rear plate 81 does not have to be provided if the substrate 71 itself has sufficient strength. In other words, the envelope 88 may also be composed of the face plate 86, support frame 82, and substrate 71 by direct sealing of the support frame 82 to the substrate 71. On the other hand, it is also possible to construct the envelope 88 with sufficient strength against the atmospheric pressure by interposing an unrepresented support called a spacer between the face plate 86 and the rear plate 81.

FIGS. 9A and 9B are schematic diagrams showing fluorescent films. The fluorescent film 84 can be made of only a fluorescent material in the monochrome case. In the case of the color fluorescent film, a fluorescent film can be made of black conductive material 91, called black stripes (FIG.

9A) or a black matrix (FIG. 9B) or the like, and fluorescent materials 92. Purposes for provision of the black stripes or the black matrix are that a mixture of colors or the like is made unobstructive by blacking the separating portions between the three primary color fluorescent materials 92 necessary for color display and that a decrease is suppressed in the contrast because of reflection of external light on the fluorescent film 84. The black conductive material 91 can be a material containing graphite as a matrix, which is normally used, or can be any electroconductive material with little transmission and reflection of light.

A method for coating the glass substrate 83 with the fluorescent material can be either one selected from a precipitation method, a printing method, and so on, irrespective of either monochrome or color. The metal back 85 is normally provided on the inside surface side of the fluorescent film 84. Purposes for provision of the metal back are that the luminance is increased by specularly reflecting light traveling to the inside surface side out of luminescence of the fluorescent material toward the glass substrate 83, that it is made to function as an electrode for applying the voltage for acceleration of electron beams, that it protects the fluorescent material from damage due to bombardment of negative ions generated in the envelope, and so on. The metal back can be made by, after production of the fluorescent film, carrying out a smoothing operation (normally called "filming") of the inside surface of the fluorescent film and thereafter depositing Al thereon by vacuum vapor deposition or the like.

The face plate 86 may also be provided with a transparent electrode (not illustrated) on the outside surface side of the fluorescent film 84 in order to enhance electric conduction of the fluorescent film 84.

On the occasion of carrying out the aforementioned sealing, the electron-emitting devices have to be aligned with the respective color fluorescent materials in the color case and thus sufficient alignment is indispensable.

Figure 19:
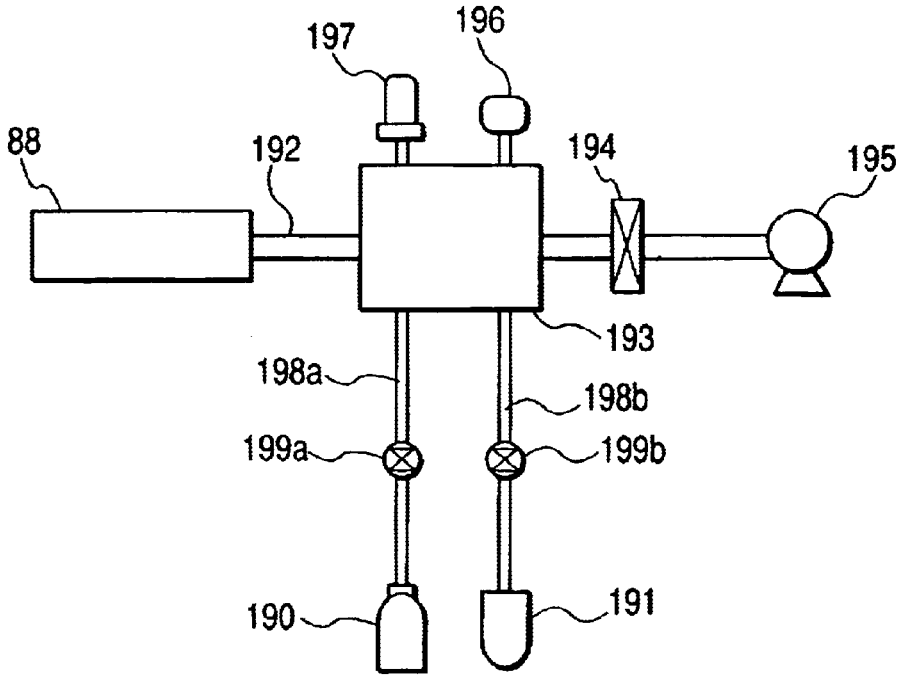
FIG. 19 is a schematic diagram of an apparatus used for production of the image-forming apparatus of the present invention.

The image-forming apparatus illustrated in FIG. 8 is produced, for example, as follows. FIG. 19 is a schematic diagram to show the schematic structure of an apparatus used for the following steps. In the figure, numeral 190 denotes a bomb, 191 an ampoule, 192 an exhaust pipe, 193 a vacuum chamber, 194 a gate valve, 195 an exhaust device, 196 a pressure gage, 197 a quadrupole mass spectrometer, 198*a*, 198*b* gas intake lines, and 199*a*, 199*b* gas intake control devices.

A display panel not subjected to forming yet is prepared. The envelope 88 of the display panel is linked through the exhaust pipe 192 to the vacuum chamber 193 and further connected via the gate valve 194 to the exhaust device 195. The vacuum chamber 193 is equipped with the vacuum gage 196, quadrupole mass spectrometer 197, etc. for measuring the inside pressure and partial pressures of the respective components in an atmosphere. Since it is not easy to directly measure the inside pressure of the envelope 88 or the like, the process conditions are controlled by measuring the pressure or the like in the vacuum chamber 193. The gas intake lines 198 are connected to the vacuum chamber 193 in order to control the atmosphere by further introducing necessary gas into the vacuum chamber 193. The envelope 88 is arranged to be heated to the temperature above the room temperature by a heater not illustrated.

Connected to the other end of each gas intake line 198 is the bomb 190 or the ampoule 191, each storing an introduced substance, as an introduced substance source. Each intake control device 199 for controlling a rate of intake of the introduced substance is provided in the middle of the associated gas intake line 198. The intake control devices 199 can be specifically selected from valves permitting control of flow rate of leak, such as slow leak valves, mass flow controllers, and so on, and are selected according to the kind of the introduced substance.

Figure 20:
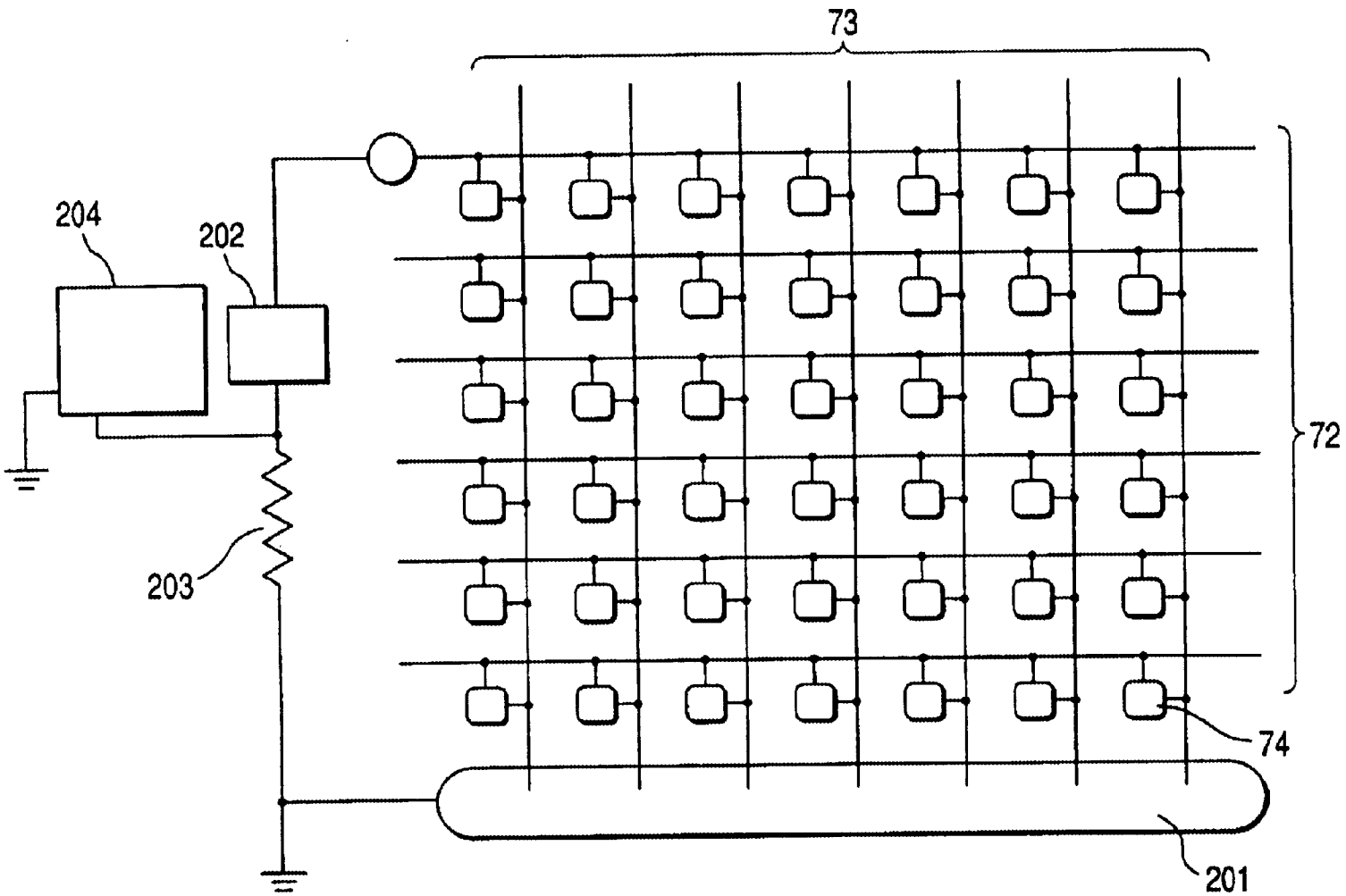
FIG. 20 is a schematic diagram showing an example of a connection state of each device in the forming step in production of the image-forming apparatus of the present invention.

The inside of the envelope 88 is evacuated by the apparatus of FIG. 19 and forming is carried out. On this occasion, the envelope 88 is heated to a temperature of not less than 50° C. by an unrepresented heater and the cohesion promoting gas according to the present invention is introduced through the gas intake line 198. On this occasion, the forming can be carried out in such a manner that, for example, as illustrated in FIG. 20, the Y-directional wires 73 are connected to a common electrode 201 and the voltage pulses are applied simultaneously to the devices connected to one of the X-directional wires 72 from a power supply 202 thereof. The shape of the pulses and the condition for determining the end of the operation can be selected according to the method for producing the electron-emitting device as described previously.

It is also possible to carry out the forming of the devices connected to plural X-directional wires together by successively applying (scrolling) phase-shifted pulses to the plural X-directional wires.

After that, the activation step is carried out according to the aforementioned method for producing the electron-emitting device. Describing in more detail, after the inside of the envelope 88 is evacuated sufficiently, an ambience containing an organic substance is established by introducing the organic substance through the gas intake line 198 or by carrying out evacuation by the oil diffusion pump or the rotary pump and using the organic substance remaining in the vacuum ambience. In certain cases a substance other than the organic substance is also introduced if necessary. When the voltage is applied to each electron-emitting device in the ambience containing the organic substance, established as described above, the carbon or carbon compound or a mixture thereof is deposited on the electron-emitting region, whereby the electron emission amount increases drastically. A method for applying the voltage to the electron-emitting devices in this activation step can be a method for applying the voltage pulses simultaneously to the devices connected to one directional wire by the similar connection to that in the forming operation.

Subsequent to the above activation step, the stabilization step is carried out according to the aforementioned method for producing the electron-emitting device. Namely, while the temperature is kept in the range of 80° C. to 250° C., the envelope 88 is heated and evacuated through the exhaust pipe 192 by the exhaust device 195 not using oil, such as the ion pump or the absorption pump, up to an ambience from which the organic substance is reduced well, e.g., into a vacuum of about $1\times10^{-5}$ Pa. After that, the exhaust pipe 192 is heated by a burner to be melted, thereby it is being cut as being sealed.

In order to maintain the pressure after the sealing of the envelope 88, a getter operation may also be carried out. This is an operation for heating a getter (not illustrated) placed at a predetermined position in the envelope 88 by resistance heating, high-frequency heating, or the like immediately before execution of the sealing of the envelope 88 or after the sealing, thereby forming an evaporated film. The getter normally contains the principal component of Ba or the like and the vacuum, for example, $1\times10^{-5}$ Pa or less, is maintained by an adsorbing action of the evaporated film.

Next, with reference to FIG. 10, a structural example of the driving circuitry for carrying out television display based on TV signals of the NTSC system on the display panel constructed using the electron source of the simple matrix configuration is described. In FIG. 10, numeral 101 designates an image display panel, 102 a scanning circuit, 103 a control circuit, 104 a shift register, 105 a line memory, 106 a synchronous signal separating circuit, 107 a modulation signal generator, and $V_x$ and $V_a$ dc voltage supplies.

The display panel 101 is connected to the external circuits via the terminals $D_{x1}$ to $D_{xm}$, the terminals $D_{y1}$ to $D_{yn}$, and high-voltage terminal 87. Applied to the terminals $D_{x1}$ to $D_{xm}$ are scanning signals for successively driving the electron source disposed in the display panel 101, i.e., the group of electron-emitting devices arranged in the matrix wiring pattern of m rows×n columns, row by row (every n devices). Applied to the terminals $D_{y1}$ to $D_{yn}$ are modulation signals for controlling output electron beams from the respective electron-emitting devices in one row selected by the scanning signal. Supplied to the high-voltage terminal 87 is the dc voltage, for example, of 10 kV from the dc voltage supply $V_a$, which is an accelerating voltage for imparting sufficient energy for excitation of the fluorescent material to the electron beams emitted from the electron-emitting devices.

The scanning circuit 102 will be described next. This circuit includes m switching devices (schematically indicated by $S_1$ to $S_m$ in FIG. 10) inside. Each switching device selects either the output voltage of the dc voltage supply $V_x$ or 0 [v] (the ground level) to be electrically connected to the terminals $D_{x1}$ to $D_{xm}$ of the display panel 101. Each switching device $S_1$ to $S_m$ operates based on a control signal $T_{scan}$ output from the control circuit 103 and can be constructed, for example, by a combination of switching devices such as FETs.

The dc voltage supply $V_x$ is set to output a constant voltage such that the driving voltage applied to the devices not scanned is not more than the electron emission threshold voltage, based on the characteristic (electron emission threshold voltage) of the electron-emitting device.

The control circuit 103 has the function to match operations of the respective sections with each other so as to carry out appropriate display based on the image signals supplied from the outside. The control circuit 103 generates control signals of $T_{scan}$, $T_{sft}$, and $T_{mry}$ to the respective sections, based on a synchronous signal $T_{sync}$ sent from the synchronous signal separating circuit 106.

The synchronous signal separating circuit 106 is a circuit for separating a synchronous signal component and a luminance signal component from the TV signal of the NTSC system supplied from the outside, which can be constructed using an ordinary frequency separation (filter) circuit or the like. The synchronous signal separated by the synchronous signal separating circuit 106 is comprised of a vertical synchronous signal and a horizontal synchronous signal, which are illustrated as a $T_{sync}$ signal for sake of explanation. The luminance signal component of an image separated from the TV signal is represented by a DATA signal for convenience. This DATA signal is input into the shift register 104.

The shift register 104 is provided for effecting serial/parallel conversion every line of image with the DATA signal serially input in time series and operates based on the control signal $T_{sft}$ sent from the control circuit 103. (In other words, the control signal $T_{sft}$ can also be mentioned as a shift clock of the shift register 104.) Data of one line of image after the serial/parallel conversion (corresponding to driving data for n electron-emitting devices) is output as n parallel signals of $I_{d1}$ to $I_{dn}$ from the shift register 104.

The line memory 105 is a storage device for storing the data of one line of image for a required period and properly stores the contents of $I_{d1}$ to $I_{dn}$ according to the control signal $T_{mry}$ sent from the control circuit 103. The contents stored are output as $I_{d'1}$ to $I_{d'n}$ to be supplied to the modulation signal generator 107.

The modulation signal generator 107 is a signal source for properly driving and modulating each of the electron-emitting devices according to each of the image data $I_{d'1}$ to $I_{d'n}$ and output signals therefrom are applied via the terminals $D_{y1}$ to $D_{yn}$ to the electron-emitting devices in the display panel 101.

As described previously, the electron-emitting devices of the present invention have the following basic characteristics as to the emission current $I_e$. Namely, the devices have the definite threshold voltage $V_{th}$ for emission of electrons, so that emission of electrons occurs only when the voltage not less than $V_{th}$ is applied. Against voltages not less than the electron emission threshold, the emission current also varies according to change of the voltage applied to each device. From this feature, where the pulsed voltage is applied to the device, emission of electrons does not occur, for example, with application of a voltage not more than the electron emission threshold voltage, but an electron beam is output with application of a voltage not less than the electron emission threshold voltage. On that occasion, the intensity of the output electron beam can be controlled by changing the peak height $V_m$ of the pulse. The total amount of charge of the output electron beam can be controlled by changing the width $P_w$ of the pulse.

Therefore, a voltage modulation method, a pulse duration modulation method, and so on can be employed as a method for modulating the electron-emitting devices according to the input signal. For carrying out the voltage modulation method, the modulation signal generator 107 can be a circuit of the voltage modulation method capable of generating voltage pulses of a constant length and properly modulating peak heights of the voltage pulses according to the input data. For carrying out the pulse duration modulation method, the modulation signal generator 107 can be a circuit of the pulse duration modulation method capable of generating voltage pulses with a constant peak height and properly modulating the widths of the voltage pulses according to the input data.

The shift register 104 and the line memory 105 can be of either a digital signal type or an analog signal type. This is because one point necessary is that the serial/parallel conversion and storage of image signals are carried out at a predetermined speed.

In the case of the digital signal type, the output signal DATA of the synchronous signal separating circuit 106 needs to be digitized and it is implemented by an A/D converter disposed at an output portion of the synchronous signal separating circuit 106. In connection therewith, the circuit used in the modulation signal generator 107 differs slightly, depending upon whether the output signals of the line memory 105 are digital signals or analog signals. Namely, in the case of the voltage modulation method using digital signals, the modulation signal generator 107 is, for example, a D/A converter and an amplifier or the like is added thereto if necessary. In the case of the pulse duration modulation method, the modulation signal generator 107 is a circuit, for example, obtained by combining a high-speed oscillator and a counter for counting the number of waves output from the oscillator with a comparator for comparing an output value from the counter with an output value from the memory. An amplifier can also be added for voltage-amplifying the modulation signal modified in pulse duration, output from the comparator, up to the driving voltage of the electron-emitting device, if necessary.

In the case of the voltage modulation method using analog signals, the modulation signal generator 107 can be, for example, an amplifier using an operational amplifier or the like and a level shift circuit or the like can also be added thereto if necessary. In the case of the pulse duration modulation method, for example, a voltage-controlled oscillator (VCO) can be employed and an amplifier can also be added thereto for voltage-amplifying the modulation signal up to the driving voltage of the electron-emitting device, if necessary.

In the image-forming apparatus of the present invention which can be constructed in the above-stated structure, electron emission occurs when the voltage is applied to each electron-emitting device via the external terminals $D_{x1}$ to $D_{xm}$, $D_{y1}$ to $D_{yn}$ outside the vessel. At the same time, the high voltage is applied via the high-voltage terminal 87 to the metal back 85 or to a transparent electrode (not illustrated), thereby accelerating the electron beams. The fluorescent film 84 is bombarded with the electrons thus accelerated to bring about luminescence, thereby forming an image.

The structure of the image-forming apparatus described herein is just an example of the image-forming apparatus of the present invention and a variety of modifications can be made based on the technical concept of the present invention. The input signals were of the NTSC system, but the input signals are not limited to this system. For example, they can be signals of the PAL system, the SECAM system, or the like, or signals of systems of TV signals comprised of more scanning lines than the foregoing systems (for example, high-definition TV systems including the MUSE system).

Next, an electron source of the aforementioned ladder-like configuration and an image-forming apparatus will be described referring to FIG. 11 and FIG. 12.

Figure 11:
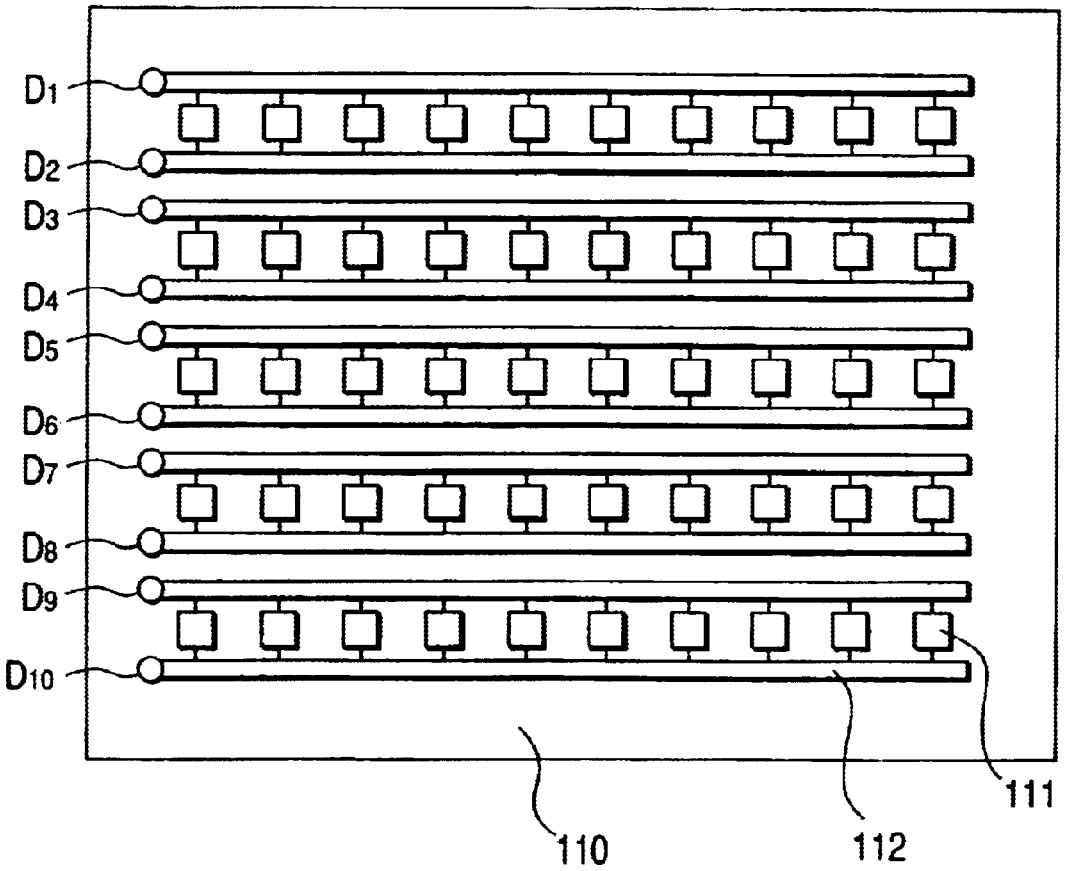
FIG. 11 is a schematic structural diagram showing an electron source of a ladder-like configuration as an embodiment of the electron source of the present invention.

FIG. 11 is a schematic diagram showing an example of an electron source of the ladder-like configuration. In FIG. 11, numeral 110 designates an electron source substrate and 111 designates electron-emitting devices. Numeral 112 represents common wires $D_1$ to $D_{10}$ for connection of the electron-emitting devices 111, which are drawn out as external terminals. The electron-emitting devices 111 are arranged in parallel rows along the X-direction (which will be called device rows). The electron source is composed of a plurality of such device rows. Each device row can be driven independently by placing the driving voltage between the common wires of each device row. Namely, a voltage of not less than the electron emission threshold is applied to a device row expected to emit electron beams, whereas the voltage of not more than the electron emission threshold is applied to a device row expected not to emit electron beams. The common wires $D_2$ to $D_9$ located between the device rows can also be formed as single integral wires; for example, $D_2$ and $D_3$ can be made as a single integral wire.

Figure 12:
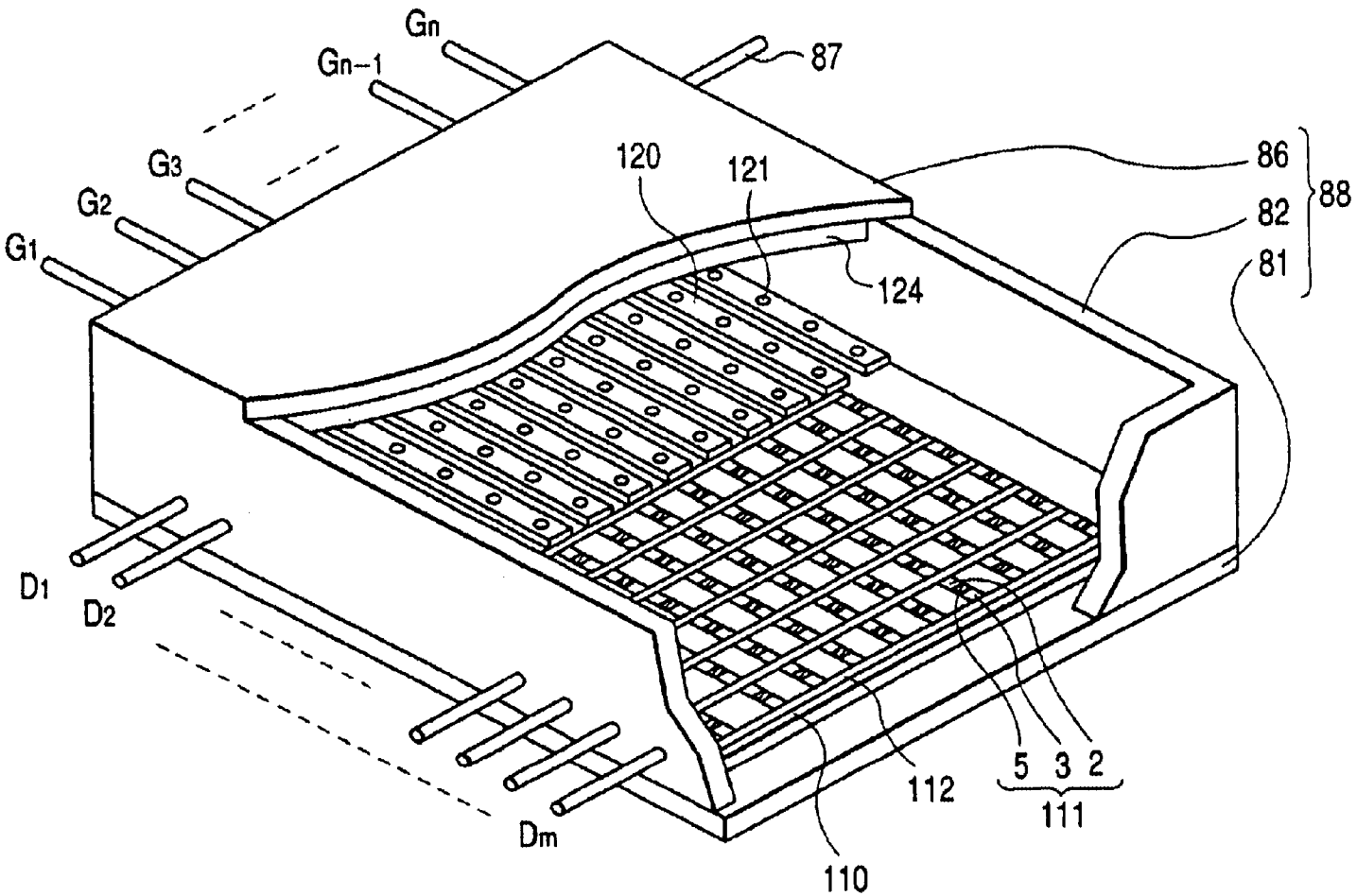
FIG. 12 is a schematic structural diagram of a display panel used in an embodiment of the image-forming apparatus of the present invention incorporating the electron source of the ladder-like configuration.

FIG. 12 is a schematic diagram showing an example of the panel structure in an image-forming apparatus provided with the electron source of the ladder-like configuration. Numeral 120 denotes grid electrodes, 121 denotes apertures for electrons to pass, $D_1$ to $D_m$ denote out-of-vessel terminals, and $G_1$ to $G_n$ denote out-of-vessel terminals connected to the grid electrodes 120. Numeral 110 denotes an electron source substrate in which the common wires between the device rows are made in the form of integral wires. In FIG. 12, the same portions as those illustrated in FIG. 8 and FIG. 11 are denoted by the same reference symbols. The conductive films 4 are omitted from the illustration for convenience. The image-forming apparatus shown herein is mainly different from the image-forming apparatus of the simple matrix configuration illustrated in FIG. 8 in that the image-forming apparatus herein is provided with the grid electrodes 120 between the electron source substrate 110 and the face plate 86.

In FIG. 12, the grid electrodes 120 are provided between the substrate 110 and the face plate 86. The grid electrodes 120 are given for the purpose of modulating the electron beams emitted from the electron-emitting devices 111 and are provided with circular apertures 121 each per device in order to let the electron beams pass the stripe-shape electrodes perpendicular to the device rows of the ladder-like configuration. The shape and arrangement of the grid electrodes are not limited to those illustrated in FIG. 12. For example, the apertures can be a lot of pass holes in a mesh pattern and the grid electrodes can be located around or near the electron-emitting devices.

The out-of-vessel terminals $D_1$ to $D_m$ and $G_1$ to $G_n$ are connected to the control circuit (not illustrated). Modulation signals for one line of image are applied simultaneously to the grid electrode array in synchronism with successive driving (scanning) of the device rows row by row. This permits the image to be displayed line by line with controlling irradiation of each electron beam onto the fluorescent material.

The image-forming apparatus of the present invention described above can be used as a display device for television broadcasting or a display device for a video conference system, a computer, or the like and in addition, it can also be used as an image-forming apparatus or the like as an optical printer constructed using a photosensitive drum or the like.

Figure 17:
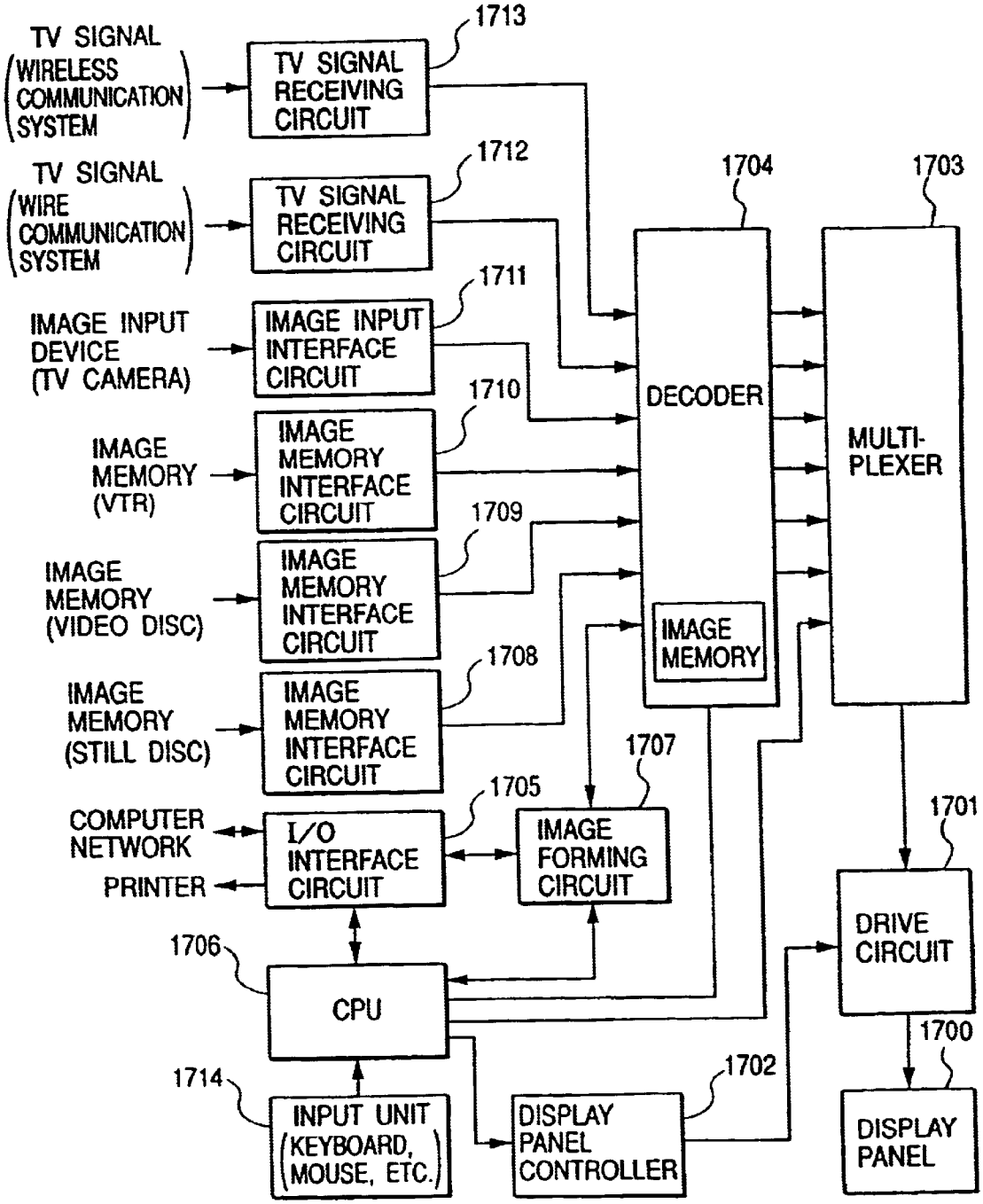
FIG. 17 is a block diagram of an embodiment of the image-forming apparatus of the present invention.
Figure 18:
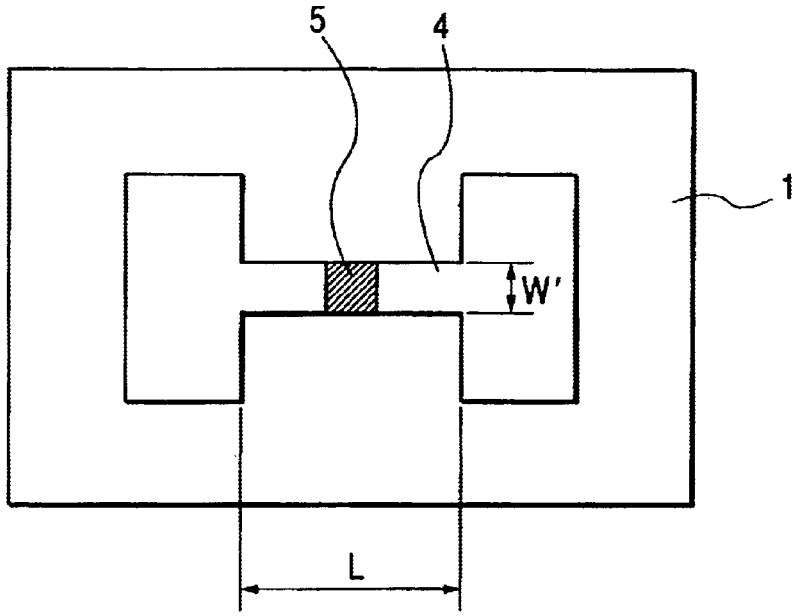
FIG. 18 is a schematic structural diagram showing a conventional plane type surface conduction electron-emitting device.

FIG. 17 is a diagram showing an example of a configuration of the image-forming apparatus of the present invention adapted to display image information provided from various image information sources, for example, including television broadcasting and the like.

In the figure, numeral 1700 represents a display panel, 1701 a drive circuit of the display panel, 1702 a display panel controller, 1703 a multiplexer, 1704 a decoder, 1705 an I/O interface circuit, 1706 a CPU, 1707 an image-forming circuit, 1708 to 1710 image memory interface circuits, 1711 an image input interface circuit, 1712 and 1713 TV signal receiving circuits, and 1714 an input unit.

The present image-forming apparatus is, of course, arranged to reproduce sound together with display of an image when receiving a signal including both an image signal and a sound signal, for example, like a television signal; however, description is omitted herein for circuits, loudspeakers, etc. concerning reception, separation, regeneration, processing, storage, etc. of the sound information not directly related to the features of the present invention.

The functions of the respective units will be described along with the flow of an image signal.

First, the TV signal receiving circuit 1713 is a circuit for receiving the TV signal transmitted through a wireless communication system, for example, such as radio waves, space optical communication, or the like. There are no specific restrictions on the system of the TV signal received and either system can be selected, for example, from the NTSC system, the PAL system, the SECAM system, and so on. TV signals comprised of more scanning lines than those used by such systems, for example, so-called high-definition TV signals by the MUSE method etc., are preferred signal sources for taking advantage of the features of the display panel suitable for large-area display and the large number of pixels.

The TV signal received by the above TV signal receiving circuit 1713 is output to the decoder 1704.

The TV signal receiving circuit 1712 is a circuit for receiving the TV signal transmitted through a wire communication system, for example, such as a coaxial cable, an optical fiber, or the like. Similarly to the TV signal receiving circuit 1713, there are no specific restrictions on the system of the TV signal received and the TV signal received by this circuit is also output to the decoder 1704.

The image input interface circuit 1711 is a circuit for capturing an image signal supplied from an image input device, for example, such as a TV camera, an image reading scanner, or the like, and the image signal thus captured is output to the decoder 1704.

The image memory interface circuit 1710 is a circuit for capturing an image signal stored in a video tape recorder (hereinafter referred to as "VTR") and the image signal thus captured is output to the decoder 1704.

The image memory interface circuit 1709 is a circuit for capturing an image signal stored in a video disk and the image signal thus captured is output to the decoder 1704.

The image memory interface circuit 1708 is a circuit for capturing an image signal from a device storing still image data, such as a still image disk, and the still image data thus captured is input into the decoder 1704.

The I/O interface circuit 1705 is a circuit for connecting the present image display device to an external output device such as a computer, a computer network, or a printer. This circuit permits input/output of image data or character and graphic information and also permits input/output of control signals and numerical data between the CPU 1706 in this image-forming apparatus and the outside in certain cases.

The image-forming circuit 1707 is a circuit for forming image data for display, based on the image data or the character and graphic information input from the outside through the I/O interface circuit 1705 or based on the image data or the character and graphic information output from the CPU 1706. This circuit incorporates circuits necessary for formation of an image, for example, including a writable memory for storing the image data or the character and graphic information, a read-only memory for storing image patterns corresponding to character codes, a processor for carrying out image processing, and so on.

The image data for a display formed by this circuit is output to the decoder 1704 and in some cases it can also be output through the I/O interface circuit 1705 to an external computer network or printer.

The CPU 1706 mainly performs control of operation of this image display apparatus and operations concerning formation, selection, and editing of a display image.

For example, the CPU 1706 outputs a control signal to the multiplexer 1703, it properly selects an image signal to be displayed on the display panel, or it properly combines image signals to be displayed. On that occasion the CPU generates a control signal to the display panel controller 1702 according to the image signal to be displayed, to properly control the operation of the display apparatus as to the screen display frequency, the scanning method (for example, either interlace or non-interlace), the number of scanning lines in one screen, and so on. The CPU also directly outputs the image data or the character and graphic information to the image-forming circuit 1707 or makes access to an external computer or memory through the I/O interface circuit 1705 to take in the image data or the character and graphic information.

The CPU 1706 may also be adapted to be engaged in operations for other purposes than those discussed above. For example, the CPU may be associated directly with the function to form or process information, like a personal computer, a word processor, or the like; or, as described previously, the CPU may be connected to an external computer network through the I/O interface circuit 1705 to perform an operation, for example, such as a numerical computation or the like, in cooperation with an external device.

The input unit 1714 is a device through which a user inputs a command, a program, or data to the CPU 1706, which can be selected from a variety of input devices, for example, such as a keyboard, a mouse, a joy stick, a bar-code reader, a voice recognition unit, and so on.

The decoder 1704 is a circuit for inverting the various image signals input from the circuits 1707 to 1713 to three-primary-color signals, or to luminance signals, and I signals and Q signals. The decoder 1704 is desirably provided with an image memory inside, as indicated by a dotted line in the figure. This is for handling the TV signal necessitating the image memory on the occasion of inversion, for example, in the case of the MUSE system and the like. Provision of the image memory facilitates the display of a still image. Moreover, it presents an advantage of facilitating the image processing and editing, including thinning, interpolation, enlargement, reduction, and synthesis of an image, in cooperation with the image-forming circuit 1707 and CPU 1706.

The multiplexer 1703 operates to properly select the display image, based on a control signal supplied from the CPU 1706. Namely, the multiplexer 1703 selects a desired image signal out of the inverted image signals supplied from the decoder 1704 and outputs the selected image signal to the drive circuit 1701. In that case, it is also possible to select image signals in a switched manner within one screen display time, thereby displaying different images in plural areas in one screen, like a so-called multi-screen television.

The display panel controller 1702 is a circuit for controlling the operation of the drive circuit 1701, based on a control signal supplied from the CPU 1706.

Concerning the basic operation of the display panel, the controller outputs a signal for controlling the operational sequence of the power supply (not illustrated) for driving the display panel, to the drive circuit 1701, for example. Concerning the driving method of the display panel, the controller outputs signals for controlling the screen display frequency and the scanning method (for example, either interlace or non-interlace) to the drive circuit 1701, for example. In some cases, the controller outputs control signals associated with adjustment of image quality, such as luminance, contrast, color tone, and sharpness of the display image, to the drive circuit 1701.

The drive circuit 1701 is a circuit for generating a drive signal applied to the display panel 1700 and operates based on an image signal supplied from the multiplexer 1703 and a control signal supplied from the display panel controller 1702.

The functions of the respective units were described above and the structure exemplified in FIG. 17 permits this image-forming apparatus to display the image information supplied from various image information sources on the display panel 1700. Specifically, the various image signals, including television broadcasting signals etc., are inverted in the decoder 1704 and thereafter an image signal is properly selected therefrom in the multiplexer 1703. The selected image signal is input into the drive circuit 1701. On the other hand, the display controller 1702 generates a control signal for controlling the operation of the drive circuit 1701 according to the image signal to be displayed. The drive circuit 1701 applies a drive signal to the display panel 1700, based on the image signal and the control signal. This causes an image to be displayed on the display panel 1700. These sequential operations are systematically controlled by the CPU 1706.

The present image-forming apparatus can display selected information out of the data stored in the image memory incorporated in the decoder 1704 and the data formed by the image-forming circuit 1707 and can also perform the following operations for the image information to be displayed; for example, image processing including enlargement, reduction, rotation, movement, edge enhancement, thinning, interpolation, color conversion, aspect ratio conversion of image, and so on, and image editing including synthesis, erasing, connection, exchange, paste, and so on. The apparatus may also be provided with a dedicated circuit for carrying out processing and editing of sound information, similar to the above image processing and image editing.

Therefore, this single image-forming apparatus can function as a display device for television broadcasting, as terminal equipment for a video conference, as an image editing device for handling a still image and a dynamic image, as terminal equipment of a computer, as terminal equipment for office use such as a word processor and the like, and as a game device and thus has a very wide application range for industries or for consumer use.

FIG. 17 is an example of the configuration where the image-forming apparatus incorporates the display panel using the electron-emitting devices as an electron beam source and it is needless to mention that the image-forming apparatus of the present invention is not limited to only this example.

For example, no trouble will arise even if the circuits associated with the functions that are not necessary for the purpose of use are omitted out of the components of FIG. 17. On the other hand, an additional component may be added depending upon the purpose of use. For example, where the present image display apparatus is applied as a video telephone, the apparatus is preferably provided with additional components such as a video camera, a sound microphone, an illuminating device, a transmitter-receiver circuit including a modem, and so on.

Since this image-forming apparatus uses the electron-emitting devices as an electron source, the display panel can be made thinner readily, so that the depth of the image-forming apparatus can be decreased. In addition, the display panel using the electron-emitting devices as an electron beam source can be formed readily in a large screen, has high luminance, and is excellent in viewing angle characteristics; therefore, the image-forming apparatus can display an image of strong appeal with full presence and with high visibility. Use of the electron source achieving the stable and high-efficiency electron emission characteristics can realize a bright and high-quality color flat television having a long lifetime.

EXAMPLES

Examples 1 to 3 and Reference Example 1

In these examples and reference example, the surface conduction electron-emitting devices were constructed in the structure illustrated in FIGS. 1A, 1B, and 1C. Steps of producing the devices of the examples and reference example will be described below.

(1) A silicon oxide film 0.5 $\mu$m thick was formed on soda lime glass cleaned, by sputtering, and this was used as the substrate 1. Formed on this substrate 1 was a mask pattern of a photoresist ("RD-2000N-41" available from Hitachi Kasei K. K.) having apertures corresponding to the pattern of the device electrodes 2, 3. Then Ti and Pt were successively deposited in the thickness of 5 nm and in the thickness of 30 nm, respectively, by vacuum vapor deposition. Then the mask pattern of the photoresist was dissolved with an organic solvent and the device electrodes 2, 3 made of the Ti/Pt films were formed by the lift-off method. The device electrode gap L was 10 $\mu$m and the device electrode length W was 300 $\mu$m.

(2) In the following step, the conductive film 4 was formed using an ink jet device. The ink jet device used included components of an ink jet printer ("BJ-10v" available from CANON Inc.). The organometallic solution for forming the conductive film 4 was a solution obtained by dissolving 0.84 g of palladium acetate monoethanolamine (hereinafter referred to as "PAME") in 12 g of water. The thermogravimetric (TG) analysis was conducted in air and X-ray diffraction (XD) measurement was further carried out. The results proved that with increase in temperature PAME started to be decomposed into metal Pd around 170° C. and PdO started to be produced at 280° C.

Using the above-stated ink jet device, a droplet of the aforementioned PAME aqueous solution was dispensed so as to make connection between the device electrodes 2, 3 and was dried. This step was repeated six times.

The droplets dispensed onto the substrate were subjected to the heating/baking operation at 350° C. for ten minutes in the atmosphere, thereby obtaining the conductive film 4 made of fine particles of PdO. This conductive film was substantially of a circular shape having the diameter of about 120 $\mu$m and a thickness of about 10 nm near the center.

(3) Then the electron-emitting region 5 was formed by the forming step. The substrate 1 with the conductive film 4 formed as described above was set in the vacuum vessel 55 of the vacuum process apparatus illustrated in FIG. 5 and the inside was evacuated down to $2.7\times10^{-4}$ Pa or less by the evacuation device 56.

Then the above substrate 1 was heated at 50° C. (Example 1), at 100° C. (Example 2), or at 150° C. (Example 3) by a heater (not illustrated). For stabilizing the temperature, this state was maintained for one hour before proceeding to the next step. For a reference purpose, one device was maintained at room temperature (about 25° C.) without heating (Reference Example 1).

The pulse voltage was placed between the device electrodes 2, 3 of each device at each temperature described above. The pulse waveforms were triangular pulses illustrated in FIG. 4A, which had a pulse peak height of 11 V, a pulse duration $T_1$ of 1 msec, and a pulse spacing $T_2$ of 10 msec. Rectangular pulses with a peak height of 0.1 V were interposed between the forming pulses to measure the current and the resistance was detected therefrom.

Then a mixture of gas of $H_2$:2% and $N_2$:98% was introduced into the vacuum vessel 55 up to the pressure of $5\times10^4$ Pa. In either device, the current flowing in the device gradually decreased at the same time as introduction of the mixture gas, then increased once, and thereafter suddenly decreased. With each of the devices heated, the resistance soon became over 1 MΩ and the application of voltage was stopped at that point. With the device not heated, the application of voltage was stopped 30 minutes after. At this time the resistance was over 1 MΩ and the I–V characteristics included a slightly ohmic component.

(4) The inside of the vacuum vessel 55 was evacuated and thereafter acetone was introduced thereinto up to the pressure of $2.7\times10^{-1}$ Pa. The rectangular pulse voltage was placed between the device electrodes 2, 3 thereby performing the activation step. The pulse duration $T_1$ was 0.5 msec, the pulse spacing $T_2$ was 10 msec, and the pulse peak height was 15 V. The pulse voltage was applied for 40 minutes.

The electron emission characteristics were measured for each of the electron-emitting devices produced as described above. Prior to the measurement, the inside of the vacuum vessel 55 was evacuated while the vacuum vessel 55 and the electron-emitting device were heated at 200° C. and at 150° C., respectively, before the pressure reached $1\times10^{-6}$ Pa or less. After this, the measurement was carried out while applying rectangular pulses having a pulse duration $T_1$=100 μsec, the pulse spacing $T_2$=10 msec, and the peak height of 15 V to the electron-emitting device and applying the voltage of 1 kV to the anode electrode 54. At this time, a spacing H between a electron-emitting device and the anode electrode 54 was 5 mm.

The device current $I_f$, emission current $I_e$, and electron emission efficiency η (%) [$=(I_e/I_f)\times100$] of each device were as follows.

TABLE 1

| Device | Forming temp | $I_f$ (mA) | $I_e$ (μA) | η (%) |
|---|---|---|---|---|
| Ex 1 | 50° C. | 1.4 | 1.5 | 0.11 |
| Ex 2 | 100° C. | 1.3 | 1.3 | 0.10 |
| Ex 3 | 150° C. | 0.60 | 0.48 | 0.08 |
| Ref Ex 1 | RT (25° C.) | 0.90 | 0.75 | 0.08 |

For each device, $I_f$ was measured at 7 V (not more than the threshold for $I_f$ in either device) to measure the ohmic current component. As a result, a current of about 0.05 mA was measured in the device of Reference Example 1, but no current was measured with the other devices. Therefore, it was verified that the production method of the present invention was effective in order to prevent appearance of the ohmic current component. (It was, however, found that the electron emission efficiency was decreased at temperatures higher than that of Example 3 and it was thus preferable to carry out the forming in an appropriate temperature range.)

Devices made up to the above step (3) in a manner similar to the above devices were taken out and observed with a scanning electron microscope (SEM) and a microscopic Raman spectrometer. The shape of the fissure formed by the forming operation was observed with an SEM and it was found that the fissure was formed across the entire width of the conductive film in devices produced under the same conditions as in Example 1 and Example 2 but the fissure was not observed in the peripheral part of the conductive film in the device produced under the same conditions as in Reference Example 1. In the device produced under the same conditions as in Example 3, portions with greater widths of the fissure were clearly more than those in the devices of Examples 1 and 2.

Figure 3:
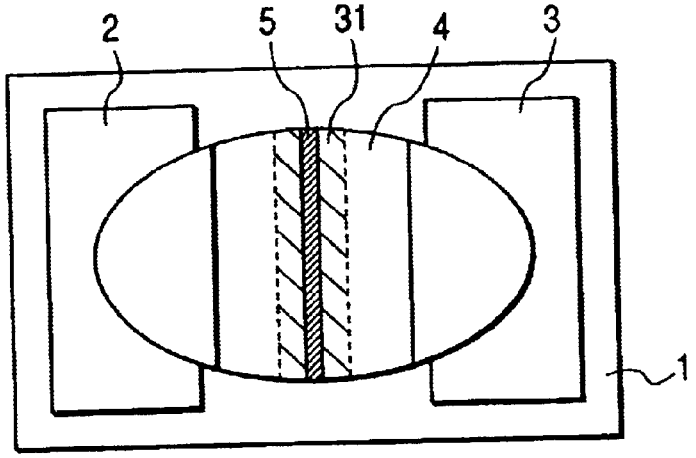
FIG. 3 is a schematic plan view showing an electron-emitting device in Example 1 of the present invention.

States of reduction of the conductive film were observed with the microscopic Raman spectrometer and it was found that the whole conductive film was almost perfect metal Pd in Example 2 and Example 3 but there existed a little PdO except for the Pd area 31 around the fissure in Example 1, as illustrated in FIG. 3. The device of Reference Example 1 was similar to that of Example 1 but it seemed to include more PdO.

Reference Examples 2, 3

Reference Example 2 and Reference Example 3 were prepared under the same conditions as Example 1 and as Example 2, respectively, except that in above step (3) the pulse voltage was applied in a vacuum the pressure of which was not more than $1\times10^{-6}$ Pa. In Reference Example 2 the resistance did not exceed 1 MΩ and thus the application of pulse was stopped 30 minutes after. In Reference Example 3 the resistance exceeded 1 MΩ after the application of voltage for the time somewhat longer than in Example 2 but not too long since the start of the pulse application and thus the application of pulse was stopped at that time.

With each of the above devices, the electron emission characteristics and the ohmic current component were measured in a fashion similar to Examples 1 and 2. As a result, an ohmic device current approximately equal to that in Reference Example 1 was measured in Reference Example 2 and the electron emission characteristics thereof were also approximately equal to those in Reference Example 1.

The device of Reference Example 3 had little ohmic current but showed $I_f$=1.0 mA, $I_e$=0.9 mA, and η=0.09%, and, therefore, the electron emission characteristics of Examples 1, 2 were superior to those of Reference Example 3. A device prepared by the same steps up to (3) in a fashion similar to Example 2 was observed with SEM and it was found that the portions with an wider widths of the fissure were slightly more than in Example 2.

It became apparent from the results of these reference examples that execution of the forming operation in the $H_2$ ambience was able to lower the temperature necessary for preventing occurrence of the ohmic current component. It was also verified that the characteristics of the electron-emitting device produced were improved even if the heating condition was the same.

Example 4

As the fourth example of the present invention, an image-forming apparatus was constructed, using the electron source as illustrated in FIG. 7, in which a lot of plane type surface conduction electron-emitting devices were arrayed in the simple matrix configuration.

Figure 13:
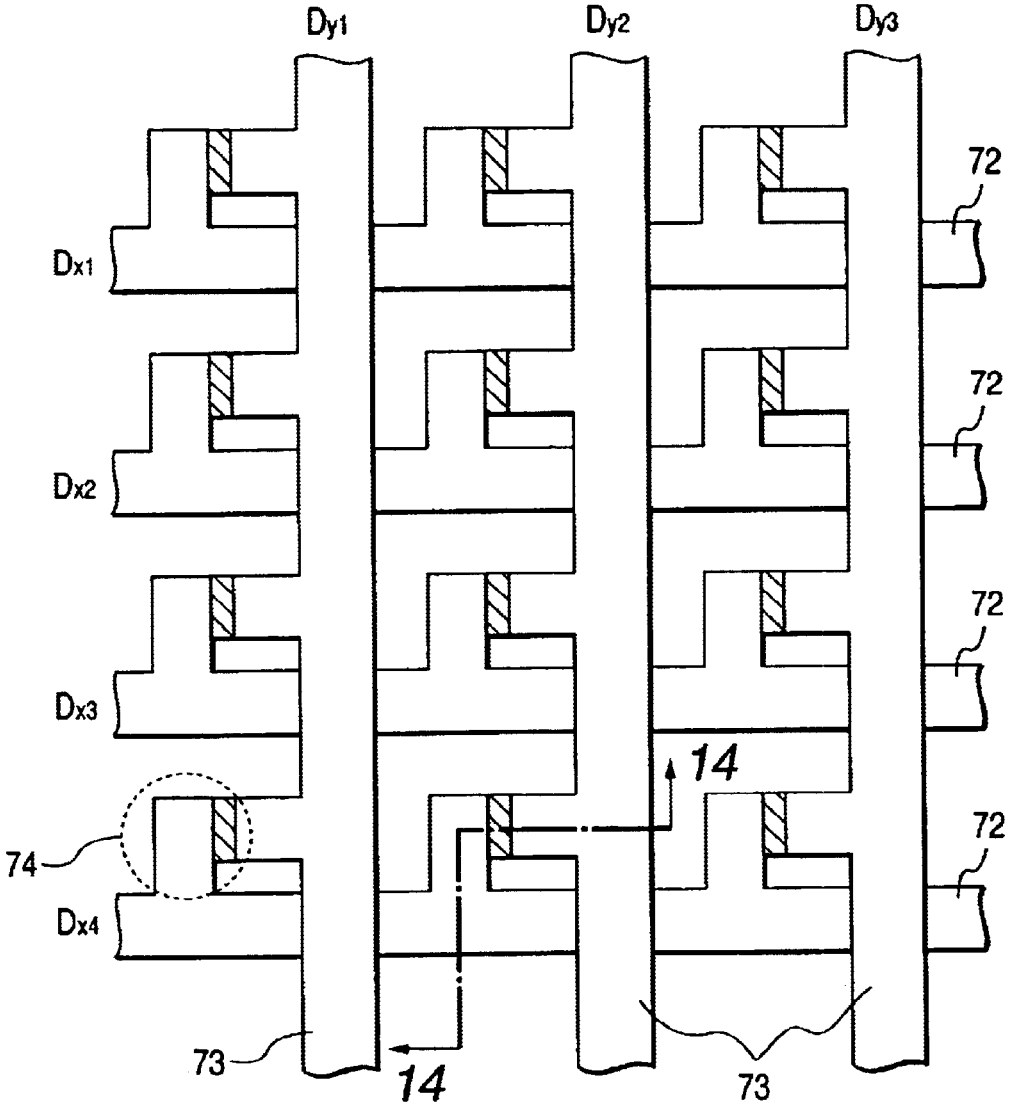
FIG. 13 is a schematic plan view showing an electron source in Example 3 of the present invention.
Figure 14:
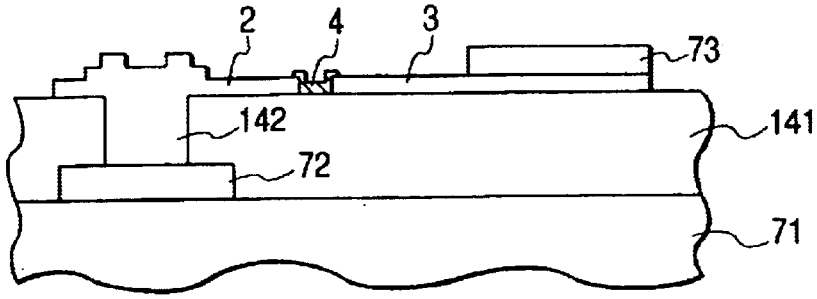
FIG. 14 is a sectional view along section line 14—14 in FIG. 13.

A plan view of part of the substrate 1 in which a plurality of electron-emitting devices are arrayed in matrix wiring, associated with the present example, is illustrated in FIG. 13. A cross section taken along line 14—14 in the figure is shown in FIG. 14 (in which the electron-emitting region 5 is omitted from the illustration).

Production steps of the electron source according to the present example are shown in FIGS. 15A, 15B, 15C, and 15D and FIGS. 16E, 16F, and 16G. In FIG. 13 to FIGS. 16E, 16F, and 16G the same reference symbols denote the same portions. Here, numeral 141 designates an interlayer insulating layer and 142 a contact hole. The steps will be described below.

Step-a

Figure 15A:
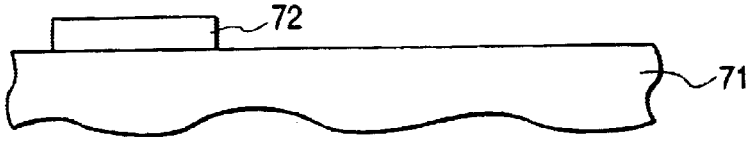
FIGS. 15A, 15B, 15C and 15D are schematic sectional views showing production steps of the electron source in Example 3 of the present invention.

A silicon oxide film 0.5 μm thick was formed on soda lime glass cleaned, by sputtering, to obtain a substrate 1 and Cr and Au were successively deposited in the thickness of 5 nm and in the thickness of 600 nm, respectively, on the substrate 1 by vacuum vapor deposition. Thereafter, a photoresist ("AZ1370" available from Heochst Inc.) was spin-coated by a spinner and baked. Thereafter, the photomask image was exposed and developed to form a resist pattern of lower wires 72 expected to become the X-directional wires. Then the Au/Cr deposited films were wet-etched to form the lower wires 72 in the desired pattern (FIG. 15A).

Step-b

Figure 15B:
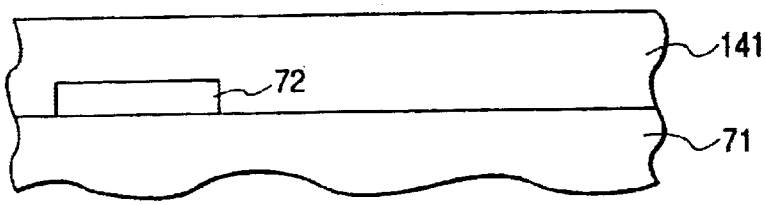

Next, the interlayer insulating layer 141 of a silicon oxide film 1.0 μm thick was deposited by RF sputtering (FIG. 15B).

Step-c

Figure 15C:
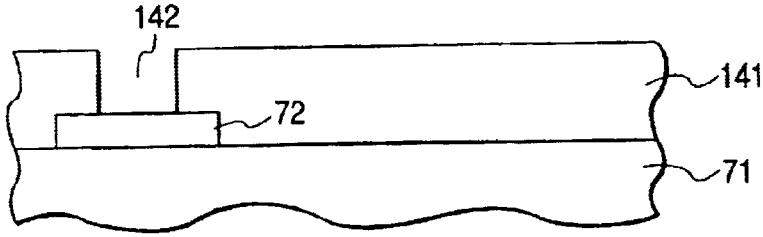

A photoresist pattern for forming the contact holes 142 was formed on the silicon oxide film deposited in step-b and, using this as a mask, the interlayer insulating layer 141 was etched to form the contact holes 142. The etching was RIE (Reactive Ion Etching) using $CF_4$ and $H_2$ gases (FIG. 15C).

Step-d

Figure 15D:
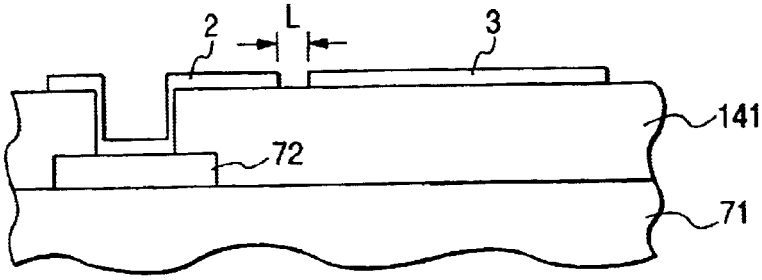

After that, a pattern expected to become the device electrodes 2, 3 and the gaps between the device electrodes was formed with a photoresist ("RD-2000N-41" available from Hitachi Kasei K. K.) and Ti and Ni were successively deposited thereon in the thickness of 5 nm and in the thickness of 100 nm, respectively, by vacuum vapor deposition. The photoresist pattern was dissolved with an organic solvent and the Ni/Ti deposited films were lifted off, thereby forming the device electrodes 2, 3 having a device electrode gap L of 10 $\mu$m and an electrode length of 300 $\mu$m (FIG. 15D).

Step-e

Figure 16E:
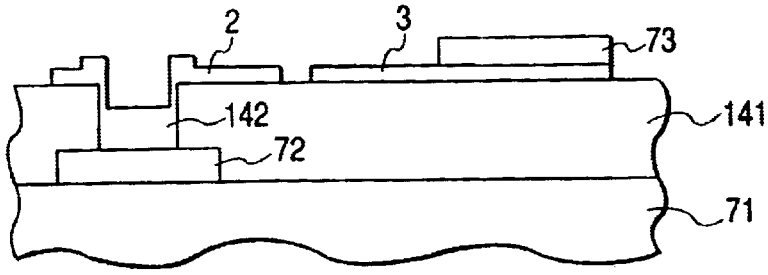
FIGS. 16E, 16F and 16G are schematic sectional views showing production steps of the electron source in Example 3 of the present invention.

A photoresist pattern of upper wires 73 expected to become the Y-directional wires was formed on the device electrodes 2, 3 and thereafter Ti and Au were successively deposited thereon in the thickness of 5 nm and in the thickness of 500 nm, respectively, by vacuum vapor deposition. Then unnecessary portions were removed by the lift-off process to form the upper wires 73 in a desired pattern (FIG. 16E).

Step-f

Figure 16F:
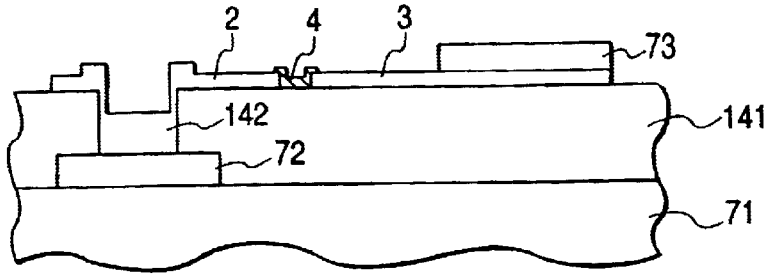

The PAME aqueous solution used in Example 1 was dropped between the device electrodes 2, 3 in a way similar to Example 1, using an ink jet device similar to that in Example 1. The solution was heated and baked at 350° C. for ten minutes, thereby forming the conductive film 4 made of fine particles of PdO (FIG. 16F).

Step-g

Figure 16G:
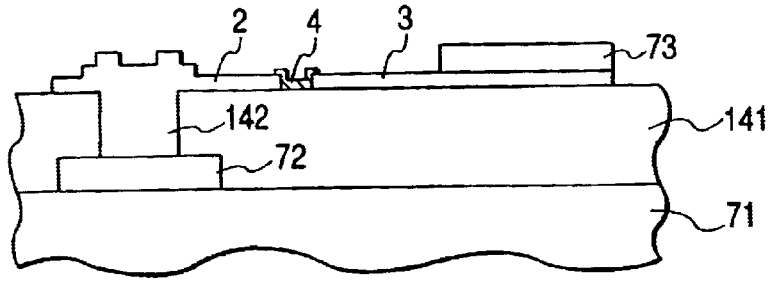

A pattern for coating the portions other than the portions of the contact holes 142 with a resist was formed and Ti and Au were successively deposited thereon in a thickness of 5 nm and in a thickness of 500 nm, respectively, by vacuum vapor deposition. Then unnecessary portions were removed by the lift-off process, thereby filling the contact holes 142 (FIG. 16G).

Then an image-forming apparatus was constructed using the not-yet-subjected-to-forming electron source prepared as described above. The process will be described with reference to FIG. 8 and FIG. 9A.

The electron source substrate 71 provided with the many surface conduction electron-emitting devices 74 as described above was fixed on the rear plate 81 and thereafter the face plate 86 (constructed by forming the fluorescent film 84 and metal back 85 on the inside surface of the glass substrate 83) was placed through the support frame 82 5 mm above the substrate 71. Frit glass was applied onto joint portions of the face plate 86, support frame 82, atmospheric pressure support (not illustrated), and rear plate 81 and baked at 430° C. in the atmosphere for ten minutes to seal them. The rear plate 81 was also fixed to the substrate 71 with frit glass.

The fluorescent film 84, which would be made of only the fluorescent material 92 in the monochrome case, was formed in the stripe pattern (FIG. 9A) of the fluorescent materials 92 in the present example; specifically, the fluorescent film 84 was made by first forming the black stripes and applying the three primary color fluorescent materials 92 to the gap portions by the slurry process. The material of the black stripes was a material containing graphite as a matrix, normally well known.

The metal back 85 was provided on the inside surface side of the fluorescent film 84. The metal back 85 was made by, after fabrication of the fluorescent film 84, carrying out a smoothing operation (normally called filming) of the inside surface of the fluorescent film 84 and thereafter depositing Al by vacuum vapor deposition.

The face plate 86 is sometimes provided with a transparent electrode on the outside surface side of the fluorescent film 84 in order to further enhance electrical conduction of the fluorescent film 84, but sufficient electrical conduction was achieved by only the metal back 85 in the present example. Therefore, a transparent electrode was not provided.

In the forming step of the present example, the vacuum process apparatus schematically shown in FIG. 19 was used, the Y-directional wires were connected to a common electrode connected to ground, and the voltage pulses applied to each of the X-directional wires had a pulse duration of 1 msec and a pulse spacing of 240 msec. Specifically, pulses with a pulse duration 1 msec and a pulse spacing 3.3 msec were generated by the pulse generator and the X-directional wire to which the voltage was applied was switched to an adjacent line every pulse by a switching device.

The pulse peak height was 11 V and the pulse waveforms were rectangular waves. During the forming operation the whole display panel was kept at 100° C. and the mixture of gas of $H_2$ and $N_2$ was introduced at the same time as the application of pulse, as in the step (3) of Example 1.

After completion of the above forming step, the activation step was carried out under the same conditions as in Example 1. In this step the way of applying the pulses was the same as in the above forming step, but the pulses were applied every ten lines of the X-directional wires, because the operation was unable to be carried out simultaneously for all the X-directional wires. Therefore, the operation was completed in order.

After this, evacuation was carried on while the whole display panel was kept at 200° C. When the pressure in the vacuum chamber reached $1\times10^{-5}$ Pa or less, the exhaust pipe was heated to be fused and sealed and then a getter device (not illustrated) placed in the envelope was heated by high frequency to effect the getter operation.

Necessary driving systems are connected to the above display panel to form an image-forming apparatus and 5 kV was applied via the high-voltage terminal (87 in FIG. 8) to the metal back to effect luminescence of the fluorescent film. The luminescence was obtained with high luminance but with little variations.

Example 5, Reference Examples 4, 5

The above discussion described only examples for forming the conductive film 4 by the ink jet method, but the following examples illustrate those by which the effect was also confirmed where the conductive film was made by other means.

As the fifth example of the present invention, an image-forming apparatus was constructed using the electron source as illustrated in FIG. 7, in which a lot of plane type surface conduction electron-emitting devices were arrayed in the simple matrix configuration.

In the present example the image-forming apparatus was constructed by the same production steps up to the forming step except for the conductive film forming step (f) as in Example 4, using the electron source substrate in which 720 devices were aligned on each line of the X-directional wire (upper wire) and 240 devices were aligned on each line of the Y-directional wire. The conductive film was made by the following step (f').

Step-f'

A Cr film 100 nm thick was deposited by vacuum vapor deposition and then was patterned, and organic Pd (ccp4230 available from Okuno Seiyaku K.K.) was spin-coated thereon by a spinner. It was heated and baked at 300° C. for ten minutes. The conductive film 4 composed of fine particles of PdO as a matrix, thus formed, had a thickness of 10 nm and a sheet resistance of $5\times10^4$ Ω/□.

After that, the Cr film 153 and the conductive film 4 after baked were etched with an acid etchant to form a desired pattern.

With the not-yet-subjected-to-forming electron source obtained by the above production steps, the image-forming apparatus was fabricated through steps similar to those in Example 4, in which during the forming operation of all the lines the peak height of voltage was 10 V and the substrate temperature was 100° C., and an image display evaluation similar to that in Example 4 was carried out. With the image-forming apparatus in the present example, dispersion distribution of luminance was measured for every pixel and the standard deviation thereof was 10% or less with respect to the average. In addition, there was little ohmic current measured.

In Reference Example 4 the substrate temperature during the forming operation was room temperature, different from Example 5, and the peak height of voltage during the forming operation was the same, 10 V. The reduction or cohesion reaction did not proceed in part of the fine particle film of PdO because of the influence of surface adsorbates or the like, described previously, and several % of all the devices were devices having an ohmic current of not less than 0.05 mA.

In order to reduce the ohmic current of Reference Example 4, Reference Example 5 was made in such conditions that the substrate temperature was room temperature and the peak height of voltage during the forming operation was 14 V. The ohmic current was not measured with any device. There appeared, however, devices with decreased electron emission amounts, because fissures were created in the conductive films 4 to increase the resistance, so as to decrease the voltage drop amounts due to the wires whereby a high voltage was applied from the electrodes 2, 3 to the conductive films 4 in which the reduction or cohesion took place slowly.

It was verified from the above results that the effect of capability of carrying out the forming without the same ohmic current and at the lower voltage was achieved even where the conductive film 4 was formed by the method except for the ink jet method.

The present invention can provide an electron-emitting device capable of presenting the good electron emission characteristics, an electron source incorporating such electron-emitting devices, and an image-forming apparatus.

The present invention can also provide, particularly, an electron-emitting device capable of presenting good electron emission characteristics, irrespective of the forming method of the conductive film, an electron source incorporating such electron-emitting devices, and an image-forming apparatus.

The present invention can also provide, particularly, an electron-emitting device capable of presenting good electron emission characteristics even with the energization operation on the conductive film having thickness irregularities, an electron source incorporating such electron-emitting devices, and an image-forming apparatus.

The present invention can also provide, particularly, an electron source having a plurality of electron-emitting devices with little variation in the electron emission characteristics.

The present invention can also provide an image-forming apparatus capable of forming a higher-quality image.

What is claimed is:

1. A method for producing electron-emitting devices wired through matrix wirings comprising a plurality of row wirings and column wirings, each electron-emitting device including a pair of electrodes and an electroconductive film having an electron-emitting region, said electroconductive film being disposed between the pair of electrodes, wherein the electron-emitting regions of the electron-emitting devices are formed by a process including the steps of:

preparing electroconductive films; and energizing said electroconductive films, while heating a substrate on which said electroconductive films are disposed at a temperature not higher than 150° C. within an atmosphere comprising a gas for promoting cohesion of the electroconductive films, wherein the step of energizing is performed by successively applying a phase shifted voltage pulse to the plurality of the row wirings.

2. The method according to claim 1, wherein the gas for promoting the cohesion of the electroconductive films is a reducing gas.

3. The method according to claim 1, wherein the gas for promoting cohesion of the electroconductive films is $H_2$, CO or $CH_4$.

4. The method according to claim 1, wherein the gas for promoting the cohesion of the electroconductive films is $H_2$.

5. The method according to claim 1, wherein the heating of the substrate is carried out at a temperature not higher than 100° C.

6. The method according to claim 1, wherein the heating of the substrate is carried out at a temperature in the range of 50° C. to 100° C.

7. The method according to claim 1, wherein each electroconductive film is formed through a step of dispensing a droplet containing a metallic compound onto a substrate.

8. The method according to claim 7, wherein the dispensing of the droplet onto the substrate is carried out by an ink jet method.

9. The method according to claim 1, wherein a material to be subjected to the heating and the energizing so as to be formulated into said electroconductive films comprises a metallic oxide.

10. The method according to claim 9, wherein said metallic oxide is palladium oxide.

11. The method according to claim 1, wherein each electron-emitting device is a surface conduction electron-emitting device.

12. A method for producing an electron source comprising a plurality of electron-emitting devices wired through matrix wirings comprising a plurality of row and column wirings, each electron-emitting device including a pair of electrodes and an electroconductive film having an electron-emitting region, said electroconductive film being disposed between the pair of electrodes, comprising the step of:

forming said plurality of electron-emitting devices by a process including the steps of:

heating, at a temperature not higher than 150° C., a substrate on which a plurality of electroconductive films are disposed; and energizing said electroconductive films, wherein said steps of heating and energizing are conducted within an atmosphere comprising a gas for promoting cohesion of the electroconductive film, and wherein the step of energizing is performed by successively applying a phase shifted voltage pulse to the plurality of the row wirings.

13. A method for producing an image-forming apparatus comprising (a) an electron source comprising a plurality of electron-emitting device wired through matrix wirings comprising a plurality of row wirings and column wirings, each electron-emitting device including a pair of electrodes and an electroconductive film having an electron-emitting region, said electroconductive film being disposed between the pair of electrodes, and (b) an image-forming member for forming an image under irradiation of electrons emitted from the electron source, the method comprising the step of:

forming said plurality of electron-emitting devices by a process including the steps of:

heating, at a temperature of not higher than 150° C., a substrate on which a plurality of electroconductive films are disposed; and energizing said electroconductive films, wherein the steps of heating and energizing are conducted within an atmosphere comprising a gas for promoting cohesion of the electroconductive films, and wherein the step of energizing is performed by successively applying a phase shifted voltage pulse to the plurality of the row wirings.

14. A method for producing an electron source comprising a plurality of electron-emitting devices wired through matrix wirings comprising a plurality of row wirings and column wirings, each electron-emitting device including a pair of electrodes and an electroconductive film having an electron-emitting region, said electroconductive film being disposed between the pair of electrodes, comprising the step of:

forming said plurality of electron-emitting devices by a process including the steps of:

preparing a plurality of electroconductive films; and energizing said electroconductive films, while heating a substrate on which said electroconductive films are disposed at a temperature of not higher than 150° C. within an atmosphere comprising a gas for promoting cohesion of the electroconductive film, wherein the step of energizing is performed by successively applying a phase shifted voltage pulse to the plurality of the row wirings.

15. A method for producing an image-forming apparatus comprising (a) an electron source comprising a plurality of electron-emitting devices wired through matrix wirings comprising a plurality of row and column wirings, each electron-emitting device including a pair of electrodes and an electroconductive film having an electron-emitting region, said electroconductive film being disposed between the pair of electrodes, and (b) an image-forming member for forming an image under irradiation of electrons emitted from the electron source, the method comprising the step of:

forming said plurality of electron-emitting devices by a process including the steps of:

preparing a plurality of electroconductive films; and energizing said electroconductive films, while heating a substrate on which said electroconductive films are disposed at a temperature of not higher than 150° C. within an atmosphere comprising a gas for promoting cohesion of the electroconductive film, and wherein the step of energizing is performed by successively applying a phase shifted voltage pulse to the plurality of the row wirings.

16. The method according to any one of claims 12 to 15, wherein the gas for promoting the cohesion of the electroconductive film is a reducing gas.

17. The method according to any one of claims 12 to 15, wherein the gas for promoting the cohesion of the electroconductive film is $H_2$, CO, or $CH_4$.

18. The method according to any one of claims 12 to 15, wherein the gas for promoting the cohesion of the electroconductive film is $H_2$.

19. The method according to any one of claims 12 to 15, wherein the heating of the substrate is carried out at a temperature of not more than approximately 100° C.

20. The method according to any one of claims 12 to 15, wherein the heating of the substrate is carried out at a temperature in the range of 50° C. to 100° C.

21. The method according to any one of claims 12 to 15, further comprising the step of forming the electroconductive film by dispensing a droplet containing a metallic compound onto the substrate.

22. The method according to claim 21, wherein the dispensing of the droplet onto the substrate is carried out by an ink jet method.

23. The method according to any one of claims 12 to 15, wherein a material to be subjected to the heating and the energizing so as to be formulated into said electroconductive film comprises a metallic oxide.

24. The method according to claim 23, wherein the metallic oxide is palladium oxide.

25. The method according to any one of claims 12 to 15, wherein the electron-emitting device is a surface conduction electron-emitting device.

26. A method for producing an electron source comprising a plurality of electron-emitting devices wired through matrix wirings comprising a plurality of row wirings and column wirings, each electron-emitting device including a pair of electrodes and an electroconductive film having an electron-emitting region, said electroconductive film being disposed between the pair of electrodes, comprising the steps of:

forming said plurality of electron-emitting devices by a process including the steps of:

preparing a plurality of electroconductive films; and energizing said electroconductive films, while heating a substrate on which said electroconductive films are disposed within a predetermined atmosphere comprising a gas for promoting cohesion of the electroconductive films, wherein after the start of the energizing and the heating, the predetermined atmosphere including the gas for promoting the cohesion of the electroconductive films is formed, and wherein the step of energizing is performed by successively applying a phase shifted voltage pulse to the plurality of the row wirings.

27. A method for producing an image-forming apparatus comprising (a) an electron source comprising a plurality of electron-emitting devices wired through matrix wirings comprising a plurality of row wirings and column wirings, each electron-emitting device including a pair of electrodes and an electroconductive film having an electron-emitting region, said electroconductive film being disposed between the pair of electrodes, and (b) an image-forming member for forming an image under irradiation of electrons emitted from the electron source, the method comprising the step of:

forming said plurality of electron-emitting devices by a process including the steps of:

preparing a plurality of electroconductive films; and energizing said electroconductive films, while heating a substrate on which said electroconductive films are disposed within a predetermined atmosphere comprising a gas for promoting cohesion of the electroconductive films, wherein, after the start of the energizing and the heating, the predetermined atmosphere including the gas for promoting the cohesion of the electroconductive films is formed, and wherein the step of energizing is performed by successively applying a phase shifted voltage pulse to the plurality of the row wirings.

28. The method according to claim 26, wherein after the start of heating, the energizing starts.

29. The method according to claim 27, wherein after the start of the heating, the energizing starts.

30. The method according to any one of claims 26–29, wherein the heating of said substrate is conducted at a temperature of not higher than 150° C.

31. The method according to any one of claims 26–29, wherein the gas for promoting the cohesion of the electroconductive film is a reducing gas.

32. The method according to any one of claims 26–29, wherein the gas for promoting cohesion of the electroconductive film is $H_2$, CO or $CH_4$.

33. The method according to any one of claims 26–29, wherein the gas for promoting the cohesion of the electroconductive film is $H_2$.

34. The method according to any one of claims 26–29, wherein the heating of the substrate is carried out at a temperature not more than 100° C.

35. The method according to any one of claims 26–29, wherein the heating of said substrate is carried out at a temperature in the range of 50° C. to 100° C.

36. The method according to any one of claims 26–29, wherein said electroconductive film is an electroconductive film formed through a step of dispensing a droplet containing a metallic compound onto a substrate.

37. The method according to claim 36, wherein the dispensing of the droplet onto the substrate is carried out by an ink jet method.

38. The method according to any one of claims 26–29, wherein said electroconductive film is an electroconductive film comprising a metallic oxide as a matrix.

39. The method according to claim 38, wherein said metallic oxide is palladium oxide.

40. The method according to any one of claims 26–29, wherein said electron-emitting device is a surface conduction electron-emitting device.

41. A method according to claim 26 or 27, wherein the heating is conducted at a temperature of not higher than 150° C.

* * * * *

UNITED STATES PATENT AND TRADEMARK OFFICE

CERTIFICATE OF CORRECTION

PATENT NO. : 6,752,676 B2
APPLICATION NO. : 09/250400
DATED : June 22, 2004
INVENTOR(S) : Masataka Yamashita et al.

It is certified that error appears in the above-identified patent and that said Letters Patent is hereby corrected as shown below:

ON THE TITLE PAGE [56] REFERENCES CITED:

Foreign Patent Documents, "1 283749 should read --1-283749
2 257552" 2-257552-- and "JP 06 012997 1/1994" should be deleted (duplicated).

COLUMN 6:

Line 5, "as" should be deleted.

COLUMN 16:

Line 54, "it is" should be deleted and "as" should read --as it is being--.

COLUMN 17:

Line 13, "rowsxn" should read --rows x n--.

COLUMN 26:

Line 21, "with" should read --with an--; and
Line 22, "an" should be deleted.

COLUMN 29:

Line 54, "the" should be deleted.

UNITED STATES PATENT AND TRADEMARK OFFICE

CERTIFICATE OF CORRECTION

PATENT NO. : 6,752,676 B2
APPLICATION NO. : 09/250400
DATED : June 22, 2004
INVENTOR(S) : Masataka Yamashita et al.

It is certified that error appears in the above-identified patent and that said Letters Patent is hereby corrected as shown below:

COLUMN 31:

Line 5, "device" should read --devices--.

Signed and Sealed this

Fifth Day of December, 2006

JON W. DUDAS
*Director of the United States Patent and Trademark Office*